US006880925B2

(12) United States Patent
Yamaguchi et al.

(10) Patent No.: US 6,880,925 B2
(45) Date of Patent: Apr. 19, 2005

(54) LIQUID DISCHARGE RECORDING HEAD, LIQUID DISCHARGE RECORDING APPARATUS, AND METHOD FOR PRODUCING STOPPER MEMBER FOR LIQUID DISCHARGE RECORDING HEAD

(75) Inventors: Yukuo Yamaguchi, Tokyo (JP); Yutaka Koizumi, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/156,941

(22) Filed: May 30, 2002

(65) Prior Publication Data

US 2002/0180826 A1 Dec. 5, 2002

(30) Foreign Application Priority Data

May 31, 2001 (JP) ..... 2001-164771

(51) Int. Cl.[7] ..... B41J 2/175
(52) U.S. Cl. ..... 347/87
(58) Field of Search ..... 347/65, 85–87; 215/355; 83/660

(56) References Cited

U.S. PATENT DOCUMENTS 4,757,331 A * 7/1988 Mizusawa ..... 347/85
5,953,031 A 9/1999 Omata et al. ..... 347/86
6,074,049 A * 6/2000 Machler ..... 347/86
6,132,036 A 10/2000 Abe ..... 347/86
6,305,790 B1 * 10/2001 Kawamura et al. ..... 347/65

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

In the liquid discharge recording head provided with a stopper member formed of an elastic member to be penetrated by a hollow needle member for liquid supply into a liquid preserving chamber in the recording head, the invention enables smooth insertion of the front end of the needle member into the stopper member without insertion failure. The liquid discharge recording head is provided with a head chip having a nozzle for discharging liquid, and a frame member connected thereto and having a liquid chamber for containing the liquid to be supplied thereto. A hole portion is formed in a portion of the frame member, and joint rubber is pressed into such hole portion. In the joint rubber, there is formed in advance a fissure hole, to be penetrated by a hollow needle provided in the main body of the liquid discharge recording apparatus and having fissures in not less than three directions from the crossing center of the fissures, in a plane perpendicular to the direction of depth of the hole portion.

15 Claims, 17 Drawing Sheets

LIQUID DISCHARGE RECORDING HEAD, LIQUID DISCHARGE RECORDING APPARATUS, AND METHOD FOR PRODUCING STOPPER MEMBER FOR LIQUID DISCHARGE RECORDING HEAD

BACKGROUND OF THE INVENTION

1. Field of the Invention

The present invention relates to a liquid discharge recording head for printing on a print medium by discharging liquid droplets from a discharge port, a liquid discharge recording apparatus on which such liquid discharge recording head is mounted, and a method of producing a stopper member for the liquid discharge recording head.

2. Related Background Art

The conventional liquid discharge recording head is provided with a carriage reciprocating in a direction substantially perpendicular to the conveying direction of a recording medium, and the liquid discharge recording head is mounted on such carriage.

The liquid discharge recording head is principally composed of a liquid discharge portion for discharging liquid from a discharge port thereof, thereby executing recording on a recording medium, and a liquid reservoir chamber containing the liquid to be supplied to such liquid discharge portion. In an ordinary type, a liquid discharge recording head is provided integrally with the liquid reservoir and mounted replaceably on the liquid discharge recording apparatus.

Such a liquid discharge recording head is not designed for liquid refilling, but is disposed of when the initial supply amount of liquid is exhausted and a new liquid discharge recording head is mounted on the scanning carriage. Consequently such a configuration is associated with a relatively high running cost if the liquid discharge recording head is replaced frequently.

On the other hand, for reducing the running cost, a configuration can be used in which the liquid reservoir is separated from the liquid discharge recording head and only the liquid reservoir is replaced when the liquid is exhausted. Also, another configuration can be used in which the liquid is supplied from an external liquid reservoir, positioned outside the liquid discharge recording head, to such liquid discharge recording head.

The configurations of the liquid discharge recording head can be classified, from the standpoint of liquid replenishment, into 1) a configuration in which the liquid reservoir is contained within the liquid discharge recording head, 2) a configuration in which the replaceable liquid reservoir is mounted on the liquid discharge recording head, and 3) a configuration in which the liquid is supplied from the remote liquid reservoir to the liquid discharge recording head, for example, through a tube member.

However, in any of these configurations, the interior of the liquid discharge recording head is maintained at the atmospheric pressure or at a negative pressure, in order to prevent liquid leakage from the liquid discharge recording head.

In the following, the features of the negative pressure generating means in the aforementioned liquid replenishing configurations of the liquid discharge recording head will be explained.

In the liquid discharge recording head containing the liquid reservoir, negative pressure generating means is generally provided in the liquid reservoir in order to maintain a negative pressure therein. The negative pressure generating means employable in such configuration can be, for example, a type for absorbing liquid (liquid absorbing type) or a mechanical type.

The liquid absorbing type has a configuration of maintaining the negative pressure by utilizing the capillary force of a porous liquid absorbent member such as polyurethane foam and retaining the liquid in such liquid absorbent member. On the other hand, the mechanical type has a configuration of maintaining the negative pressure in the liquid reservoir by contracting a flexible wall portion, for example, utilizing the repulsive force of an elastic member.

In the following, the liquid discharge recording head having the replaceable liquid reservoir will be explained. In such head, the negative pressure generating means of the liquid absorbent type is generally employed. Thus, the liquid in the reservoir is prevented from dropping from the connection aperture thereof by the liquid retaining power of the porous liquid absorbent member or the like.

In the following, the liquid discharge recording head relying on the liquid supply from the external liquid reservoir will be explained. In such head, the negative pressure generating means can be the liquid absorbent type, the mechanical type, or a type in which the liquid level of the external liquid reservoir is positioned lower than the discharge port face of the liquid discharge recording head to generate a water head therebetween, thereby maintaining the interior of the liquid discharge recording head at a negative pressure.

For discharging liquid droplets from the liquid discharge recording head, there are already known, for example, a configuration of discharging a small liquid droplet from a discharge port utilizing thermal energy generated by an electrothermal converting member, and a configuration having a pair of electrodes to discharge a liquid droplet under deflection. Among these, the ink jet recording head utilizing thermal energy for liquid droplet discharge is capable of recording at a high resolution because the liquid discharge portion (discharge port) for discharging recording liquid to form a flying liquid droplet can be arranged at a high density. Also, this type of recording head is capable of easily making the entire head compact, and, therefore, has already been commercialized.

The ink jet recording head utilizing thermal energy for discharging recording liquid is provided with plural sets of discharge ports (orifices) for discharging liquid, a liquid flow path communicating with the discharge ports and an electrothermal converting element positioned corresponding to the liquid flow path. The recording head is constructed to execute the recording operation by supplying the liquid in the liquid flow path with discharge energy from the electrothermal converting element (for example, thermal energy for causing film boiling in the liquid), thereby discharging the liquid as a liquid droplet from the discharge port.

In the following, with reference to FIG. 15, the general configuration of the above-described ink jet recording head will be explained.

In a conventional ink jet recording head H shown in FIG. 15, an element substrate (heater board) 1107, provided with a heat generating element (heater) 1106 constituting an energy generating member for generating energy to be utilized for liquid discharge, is die bonded to a support member 1110 composed, for example, of aluminum or ceramics. On the support member 1110 there is adhered, in addition to the element substrate 1107, a wiring board 1108 for electrical contact with the main body of the recording apparatus, and the element substrate 1107 and the wiring board 1108 are electrically connected by wire bonding or lead bonding.

The element substrate 1107 is provided therein, in addition to the heat generating element, with a driving shift register and wiring patterns, which are formed in advance in the element substrate 1107 by silicon processing technology, together with the heat generating element 1106. The wiring board 1108 is also provided with a contact pad (not shown) for electrical contact with the main body of the liquid discharge recording apparatus.

A top plate 1100, formed, for example, by injection molding of a resinous material so as to be integral with an orifice plate 1101, is adjoined to the surface of the element substrate 1107 and the front end faces of the element substrate 1107 and the support member 1110. In the orifice plate 1101, there are formed fine discharge ports 1102 for discharging liquid droplets. In the adjoined portion of the top plate 1100 with the element substrate 1107, there are formed recesses constituting liquid flow paths 1103 communicating with the discharge ports 1102 and a recess constituting a liquid chamber 1104 communicating with the liquid flow paths 1103. In the top plate 1100, there is also formed a recording liquid supply aperture 1105 to communicate with the liquid chamber 1104, thereby supplying the recording liquid thereto.

The top plate 1100 is fixed to the element substrate 1107 by unrepresented pressing means such as a spring or adjoining means such as adhesive, and the liquid flow paths 1103 and the liquid chamber 1104 are defined by the wall portion of the top plate 1100.

The top plate 1100 need not necessarily be formed integrally with the orifice plate as explained in the foregoing, but there may also be adopted a configuration in which the orifice plate 1101 is formed separately from the top plate 1100 and is later adjoined thereto.

In the latter configuration in which the orifice plate 1101 is formed separately from the top plate 1100, there is employed a method of aligning the discharge ports 1102 on the orifice plate 1101 with respect to the liquid flow paths 1103 formed by pressed contact of the element substrate 1107 and the top plate 1100, and then adjoining the orifice plate 1101 to the top plate 1100 and the support member 1110. Such method has an advantage that the material for the orifice plate 1101, requiring durability, can be selected arbitrarily.

On the other hand, in the former configuration in which the orifice plate 1101 is integrally formed with the top plate 1100, since the discharge ports 1102 are formed in communication with the recesses constituting the liquid flow paths 1103, there can be attained excellent productivity as the liquid flow paths 1103 can be formed by simple mechanical pressing of the top plate 1100 and the element substrate 1107.

In case of the latter configuration, the top plate 1100 is formed, for example, with silicon, ceramics, or resinous material, while the orifice plate 1101 is formed, for example, with silicon, resinous material, stainless steel (SUS), nickel, or ceramics by an ultrafine working method such as laser working, electroforming, molding, anisotropic etching, or pressing.

The ink jet recording apparatus employing the above-described ink jet recording head H is principally used as a color printer by connecting to a word processor or a personal computer, and is also utilized as a driving engine for a facsimile apparatus or a copying apparatus.

SUMMARY OF THE INVENTION

Recently, the above-described ink jet recording apparatus is becoming popular in various fields, with an increase in the recording capacity of the apparatus resulting in an increase in the consumption of the recording liquid. As a result, there is rapidly increasing demand for an ink jet recording apparatus with a large liquid preserving capacity.

However, in the liquid discharge recording head with the integral liquid reservoir or the liquid discharge recording head with the replaceable liquid reservoir explained in the foregoing, the contained liquid amount is inevitably limited and frequent replacement of the liquid reservoir or the liquid discharge recording head is required in case of a large consumption of the liquid, resulting in cumbersome operations required for the operator and an increased cost of the consumables.

On the other hand, an increase in the liquid preserving capacity results in an increase in the weight of the liquid discharge recording head and an increase in the inertia in the scanning motion of the carriage, thus deteriorating the stability in the scanning motion of the carriage and also deteriorating the recording quality.

Also, an increase in the size of the liquid reservoir mounted on the carriage will lead to an increase in the size of the entire liquid discharge recording apparatus.

On the other hand, the configuration of the liquid discharge recording head in which the liquid is supplied from an external liquid reservoir has an advantage that the liquid reservoir can be made larger in capacity without increasing the size of the entire apparatus, since such liquid reservoir enables freedom in the position of installation thereof.

Also, the configuration of maintaining the interior of the liquid discharge recording head at a negative pressure by the water head between the discharge port face of the liquid discharge recording head and the liquid level in the liquid reservoir positioned outside the recording head is much simpler in comparison with the configuration utilizing the negative pressure generating means of the liquid absorbent type or mechanical type, whereby the entire apparatus can be made inexpensive.

However, the aforementioned configuration of the liquid discharge recording head maintaining the negative pressure therein by the water head has been associated with the following drawbacks.

In general, the liquid discharge recording head and the externally provided liquid reservoir are connected by a tube member, and the liquid discharge recording head is provided with a stopper member formed by an elastic material such as rubber. When the liquid discharge recording head is mounted on the carriage, usually a needle-shaped member communicating with the external liquid reservoir is inserted in such stopper member whereby the liquid discharge recording head communicates with the external liquid reservoir. In such communication state between the liquid discharge recording head and the external liquid reservoir, the needle member and the stopper member have to be in a hermetically sealed state in order not to cause leakage of air or ink at the connecting portion thereof.

On the other hand, when the needle member is extracted from the stopper member, the stopper member has to be tightly closed in order to prevent leakage of the ink from the liquid discharge recording head. In order to meet such requirements, the stopper member is generally composed of a rubber material or another material of low hardness.

At the inserting operation of the needle member into the stopper member, when the front end of the needle member impinges on and presses the stopper member, the stopper member is elongated to cause a depression deformation in the peripheral area of the position pressed by the needle member. When the needle member is further pressed into the stopper member from such state, the needle member penetrates a fissure portion of the stopper member to the opposite side thereof and is inserted into the liquid discharge recording head. However, if the stopper member is composed of a material of low hardness, the elongation of the stopper member becomes larger to increase the entering stroke of the needle member until the completion of insertion. This increases the frictional force generated between the surface of the needle member and the stopper member at the insertion of the needle member, whereby the inserting load of the needle member becomes larger.

Also, at the insertion of the needle member, since the frictional force between the stopper member and the needle member becomes very large because of the frictional coefficient of the stopper member and the contracting force acting on the external periphery of the needle member, the fissured portion of the stopper member sticks to the external periphery of the needle member once the front end of the needle member passes through the stopper member, whereby the amount of depression deformation of the stopper member increases with the further entry of the needle member. Thus, in the penetrating state of the needle member, the stopper member retains such depression deformation. Because of such depression deformation of the stopper member, the moving distance of the needle member from a retracted position to the penetrating position has to be determined in consideration of the amount of the aforementioned depression deformation of the stopper member, and this fact is a factor leading to the bulkiness of the apparatus.

Furthermore, in a configuration in which the needle member having a sharply pointed front end is inserted into the stopper member for achieving communication between the external liquid reservoir and the liquid discharge recording head, there has to be provided protective means in order that the operator cannot touch the front end of the needle member. Also, in a configuration where the front end of the needle member breaks open the stopper member to achieve insertion of the needle member, the load applied to the stopper member by the needle member becomes very large, so that the fissures formed in the stopper member may expand by the repetition of insertion and extraction of the needle member, whereby the closing ability of the stopper member may be deteriorated.

On the other hand, there is proposed a method of forming in advance a fissure-shaped hole as a linear slit in the stopper member, thereby reducing the inserting load of the needle member. Such fissure-shaped hole is formed in the stopper member by inserting therein a punch member having a conical shape in the front end and a cylindrical shape in the rear portion. More specifically, by the insertion of the front end portion of the punch member, the stopper member is fissured to form a small fissure-shaped hole therein. Then, by further insertion of the punch member into the stopper member, the fissure proceeds by the stress concentrated in one or two positions, whereby a linear or curved single slit is formed in the stopper member. However, the following drawbacks are encountered in the case that the hole formed in the stopper member is a fissure-shaped hole of such single slit.

At the insertion of the front end of the needle member, there may result insertion failure of the needle member if the front end thereof impinges on the stopper member in a position out of the slit forming area of the stopper member. More specifically, in such case, the point of the stopper member pressed by the needle member causes depression deformation whereby the needle member cannot reach the fissured hole of the stopper member, but remains in such pressed position. More specifically, because the stopper member is fissured by the fissure-shaped hole, the elastic repulsive force thereof is lowered to enhance the depression deformation, whereby the front end of the needle member engages in the depressed portion of the stopper member and cannot reach the fissure portion thereof.

Because of the above-described phenomenon, it is necessary to set the relative relationship of the position of the needle member and the direction of the slit of the stopper member with high precision in such a manner that the entering trajectory of the front end of the needle member is positioned on the slit of the stopper member or in the vicinity thereof. Such high precision layout deteriorates the productivity of the liquid discharge recording apparatus and raises the cost of the entire apparatus.

In consideration of the foregoing, an object of the present invention is to provide a liquid discharge recording head, provided with a stopper member consisting of an elastic member to be penetrated by a hollow needle member for liquid supply to a liquid chamber in the recording head, enabling smooth insertion of the front end of the needle member into the stopper member without insertion failure of the needle member at the insertion thereof into the stopper member, and an inexpensive liquid discharge recording apparatus provided with such recording head. Another object of the present invention is to provide a method enabling, in the manufacture of the stopper member to be provided in the aforementioned liquid discharge recording head, to produce the stopper member free from the insertion failure of the needle member.

The above-mentioned objects can be attained, according to the present invention, by a liquid discharge recording head provided with plural discharge ports for discharging liquid droplets, plural flow paths respectively communicating with the aforementioned discharge ports, plural energy generating elements provided respectively corresponding to the aforementioned flow paths and adapted to generate energy for discharging the liquid in the flow paths from the aforementioned discharge ports, a first common liquid chamber positioned upstream of the aforementioned plural flow paths for supplying the aforementioned plural flow paths with the liquid, a liquid supply path for supplying the aforementioned first common liquid chamber with the liquid, a second common liquid chamber provided at the upstream side of the aforementioned liquid supply path and containing the liquid to be supplied to the aforementioned liquid supply path, and a frame member constituting the aforementioned second common liquid chamber, wherein a hole portion for liquid injection into the aforementioned second common liquid chamber is provided in a part of the aforementioned frame member, a stopper member consisting of an elastic member is provided in the aforementioned hole portion so as to close the aforementioned hole portion, and the aforementioned stopper member is provided, in a plane substantially perpendicular to the direction of the depth of the aforementioned hole portion, with a fissure hole formed in the aforementioned direction of depth and having fissures in not less than three directions from the center of crossing the fissures, whereby, in a state in which a hollow needle-shaped member for liquid supply into the aforementioned second common liquid chamber is inserted into the aforementioned fissure hole, the liquid is supplied into the aforementioned second common liquid chamber through the needle member.

The fissure hole is preferably provided, in a plane substantially perpendicular to the direction of depth of the aforementioned hole portion, with fissures in not less than three directions, but not exceeding five directions, more preferably in three or four directions, and most preferably in three directions. Also, for the fissure hole having fissures in three directions, fissures in substantially a Y-shape in a plane substantially perpendicular to the direction of depth of the aforementioned hole portion are preferred.

Also, it is preferred that the crossing center of the fissures substantially coincides with the center of the face perpendicular to the direction of depth of the fissure hole of the stopper member.

Also, it is preferred that the distance from the front end of a fissure section formed by two adjacent fissures to the base portion of each fissure does not exceed ½ of the external diameter of the aforementioned needle member.

Also, in the aforementioned liquid discharge recording head, it is preferred that the size of the stopper member is larger than the cross-sectional size of the hole portion of the aforementioned frame member in a direction perpendicular to the direction of depth thereof, and that the stopper member is pressed into the hole portion.

It is further preferred that the fissure hole of the stopper member is formed therein before the stopper member is pressed into the hole portion of the frame member.

It is further preferred that a porous member is provided between the aforementioned liquid supply path and the aforementioned second common liquid chamber.

Also, the liquid discharge recording apparatus of the present invention is provided with a carriage capable of mounting a liquid discharge recording head of any of the aforementioned configurations and executing a reciprocating motion, a main tank containing liquid to be supplied to the aforementioned second common liquid chamber of the liquid discharge recording head, and a hollow needle-shaped member to be inserted in the fissure hole of the aforementioned stopper member of the liquid discharge recording head on the carriage for supplying the second common liquid chamber with the liquid in the aforementioned main tank.

Further, the method of the present invention is for producing a stopper member for closing a hole portion of a liquid discharge recording head provided with a nozzle for discharging liquid to a recording medium for recording thereon, a liquid chamber for containing the liquid to be supplied to the nozzle, and the aforementioned hole portion formed for supplying the liquid chamber with liquid, the method comprising a step of forming, in the stopper member, a fisssure hole to be penetrated by a needle-shaped member for liquid supply into the liquid chamber, in the direction of the depth of the hole portion, wherein the fissure hole has fissures in not less than three directions from the crossing center of the fissures in a plane perpendicular to the direction of depth of the hole portion. Also, the aforementioned fissure hole is preferably formed by piercing the stopper member with a punch member having a front end portion of a polygonal pyramidal shape.

The aforementioned punch member is preferably provided with a front end portion of triangular or rectangular pyramidal shape, and more preferably with a front end portion of triangular pyramidal shape.

More preferably, the aforementioned punch member is provided with a front end portion of triangular pyramidal shape, an intermediate portion of triangular pillar shape and a rear end portion of cylindrical shape, mutually connected in this order.

It is also preferred that the external diameter of the aforementioned rear end portion of cylindrical shape substantially coincides with the external shape of the aforementioned needle member.

It is also preferred, in piercing the stopper member with the punch member, to hold the stopper member by a holding member in a peripheral portion of the pierced part of the stopper member.

It is also preferred, in piercing the stopper member with the punch member, to pierce the stopper member with the punch member from a face of the stopper member opposite to the face thereof initially coming into contact with the aforementioned needle member at the insertion of the needle member into the fissure hole of the stopper member.

According to the above-described invention, in the liquid discharge recording head of a configuration in which the liquid supply from an external liquid reservoir to the liquid discharge recording head is achieved by penetrating the stopper member of the liquid discharge recording head, for example, with the needle member provided in the liquid discharge recording apparatus, by forming in advance a fissure hole having fissures in not less than three directions from the crossing center of the fissures in a portion of the stopper member to be penetrated by the needle member, the fissure hole of the stopper member in a closed state is separated under depression into not less than three fissured sections when the stopper member is pressed by impingement of the needle member, whereby the front end of the needle member can be smoothly guided to the central portion of the fissure hole.

Also, the stopper member causes depression deformation by the insertion of the needle member, but each separated fissure section is retracted with bending deformation, so that the front end portion of the needle member is not hindered by the surface elongation of the stopper member as in the case of single slit. On the other hand, when the needle member is extracted from the fissure hole, the fissured sections of the stopper member promptly return to the predetermined positions by elastic recovery.

Also, even in a case that the entering trajectory of the front end of the needle member into the stopper member does not coincide with the position of the fissures in the stopper member, or in a case that the center of the needle member is displaced from the crossing center of the fissures (namely, the position where three or more fissures mutually cross), the fissured section (section separated by the fissures) contacted by the front end of the needle member is promptly retracted by bending deformation. Thereafter the front end of the needle member is gradually guided to the crossing center of the fissures of the stopper member by the repulsive force of the deformed and retracted fissure section, and then other fissure sections also cause bending deformation under further insertion of the needle member, whereby the needle member can be smoothly inserted into the stopper member.

As explained in the foregoing, the formation in advance of the fissure hole having fissures in not less than three directions in the stopper member decreases the frictional resistance between the needle member and the stopper member thereby reducing the inserting load and extracting load of the needle member and improving the operability of the liquid discharge recording head at the replacing operation. Also, it is not necessary to precisely set the relative position of the needle member and the stopper member, so that the liquid discharge recording apparatus can be made less expensive.

Also, since the stopper member is pressed into a hole smaller than the external diameter of the stopper member, the walls of the fissure hole are mutually contacted by the elastic repulsive force of the stopper member whereby the stopper member maintains the closed state in the non-inserted state of the needle member. Therefore, when the needle member is extracted at the replacement of the liquid discharge recording head, no leakage of air or liquid occurs from the fissure hole. Also, in the inserted state of the needle member, a gripping force is applied to the needle member by the compressive force of the stopper member, thereby preventing leakage of liquid or air in the penetrated portion of the stopper member.

Also, since the fissure hole of the stopper member is formed in advance before the stopper member is pressed into the hole portion of the frame member, the needle member is inserted or extracted along the fissure hole of the stopper member and the inserting load and extracting load of the needle member is reduced in comparison with the configuration in which the stopper member is fissured by inserting a needle member with a sharp front end, whereby the operability is improved in the replacement of the liquid discharge recording head.

The method of the present invention for producing the stopper member of the liquid discharge recording head is not particularly limited. Such methods include cutting desired fissures in the stopper member with a blade such as a cutter, a method of forming the fissure hole by mold transfer at the molding preparation of the stopper member, or a method of penetrating the stopper member with a member having sharp blade-shaped ridges matching the shape of the desired fissures as long as such method can form a fissure hole having fissures in not less than three directions. The preferred method, however, involves piercing the stopper member with a punch member having a front end portion of polygonal pyramidal shape, thereby forming the aforementioned fissure hole in the direction of depth of the hole portion in which the stopper member is to be pressed. This method is preferred because of its security and simplicity.

Also, in the aforementioned producing method, there is employed a punch member provided with the aforementioned front end portion, an intermediate portion of polygonal pillar shape, and a rear end portion of cylindrical shape connected in this order, whereby, in a first stage of forming the fissure hole in the stopper member, the front end portion of the punch member is inserted into the stopper member and the stopper member is fissured by the ridges extending from the apex of the polygonal pyramidal shape at the front end portion of the punch member. In a succeeding second stage, the intermediate portion of the punch member is inserted to cleave the stopper member to a predetermined fissure depth while retracting the fissured sections under depression. In a final third stage, the rear portion of the punch member having the desired external diameter is inserted to simulate the insertion of the needle member in advance. Such formation of the fissure hole, by piercing the stopper member with the front end portion, intermediate portion, and rear portion of the punch member in succession and in this order, allows the formation of a highly reliable fissure hole in the stopper member, thereby enabling stable insertion and extraction of the needle member into and from the stopper member.

Also, in piercing the stopper member with the punch member, by holding the stopper member with a holding member in the periphery of the pierced portion of the stopper member, the amount of surface elongation of the stopper member is restricted at the entry of the front end portion of the punch member into the stopper member, thereby reducing the fluctuation in the fissure depth, resulting from the large surface elongation of the stopper member. Also, in retracting the punch member from the stopper member after the formation of the fissure hole, by holding the stopper member by the holding member under pressure, the stopper member is not pulled out by the retracting punch member and the efficiency of production of the stopper member can be improved.

Furthermore, in piercing the stopper member with the punch member, the insertion of the punch member is executed from a face of the stopper member opposite to the face coming initially into contact with the needle member at the penetration thereof into the fissure hole of the stopper member, whereby, even if the fissured portion of the stopper member causes deformation by the movement of the punch member at the retraction thereof from the stopper member after the formation of the fissure hole, such deformation causes a depression in the face of the stopper member coming initially into contact with the needle member; therefore, the insertion of the needle member into the stopper member is not hindered.

DESCRIPTION OF THE PREFERRED EMBODIMENTS

Now the present invention will be clarified in detail by describing embodiments thereof, with reference to the accompanying drawings.

Figure 1:
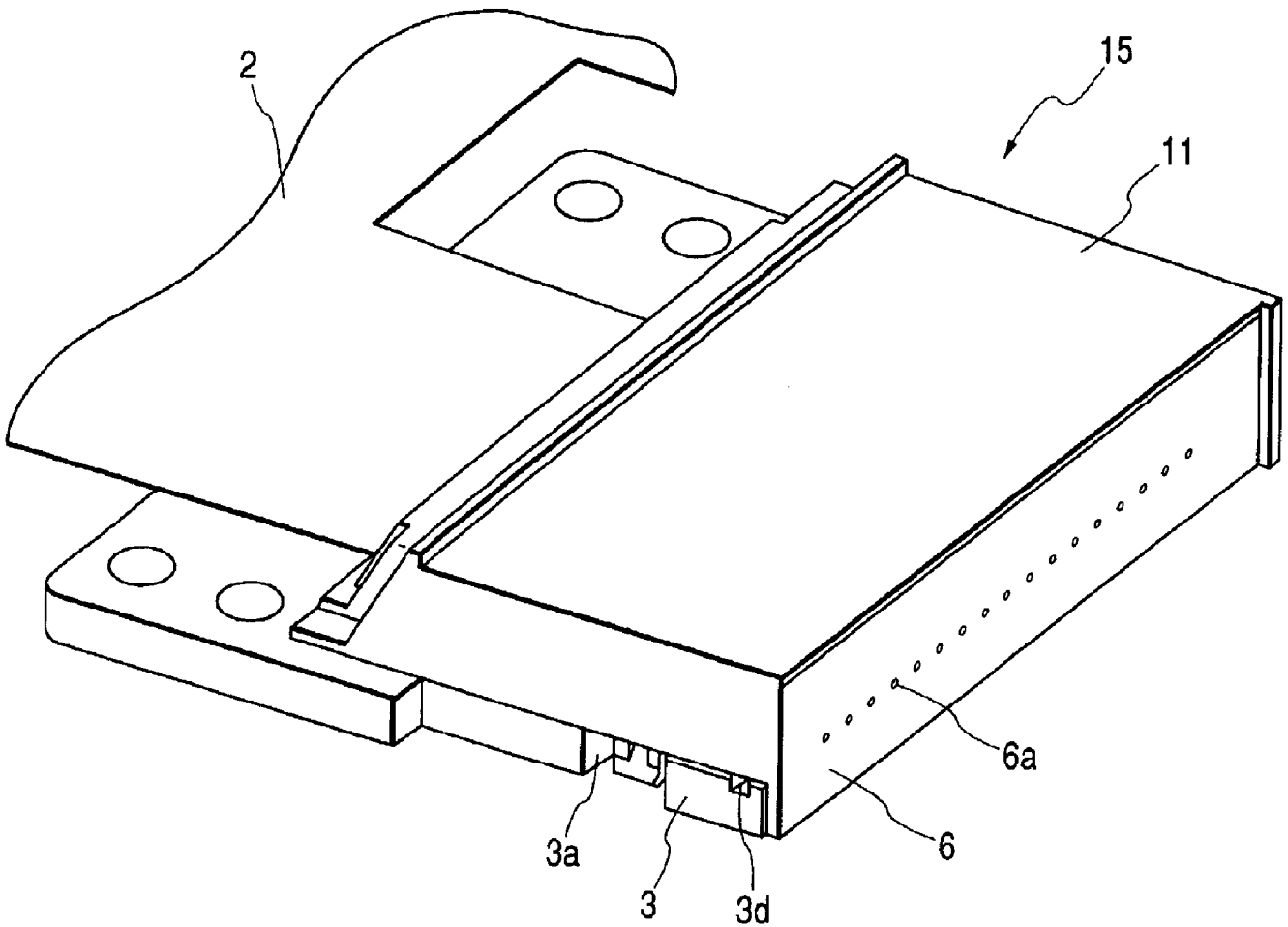
FIG. 1 is a schematic perspective view showing a configuration of a liquid droplet discharging portion of a liquid discharge recording head constituting an embodiment of the present invention.
Figure 2:
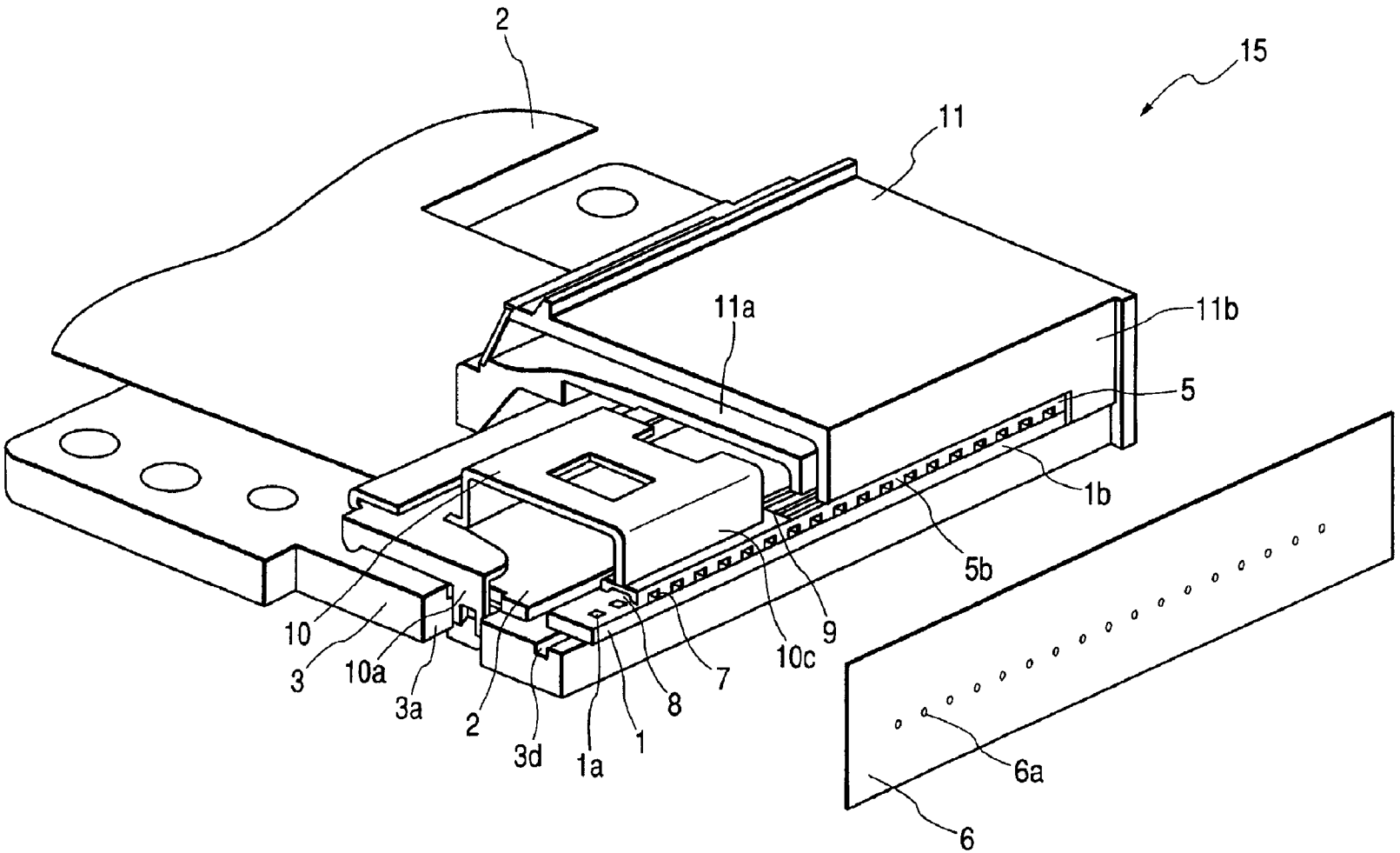
FIG. 2 is a partially cut-off perspective view of the liquid droplet discharging portion shown in FIG. 1.
Figure 3:
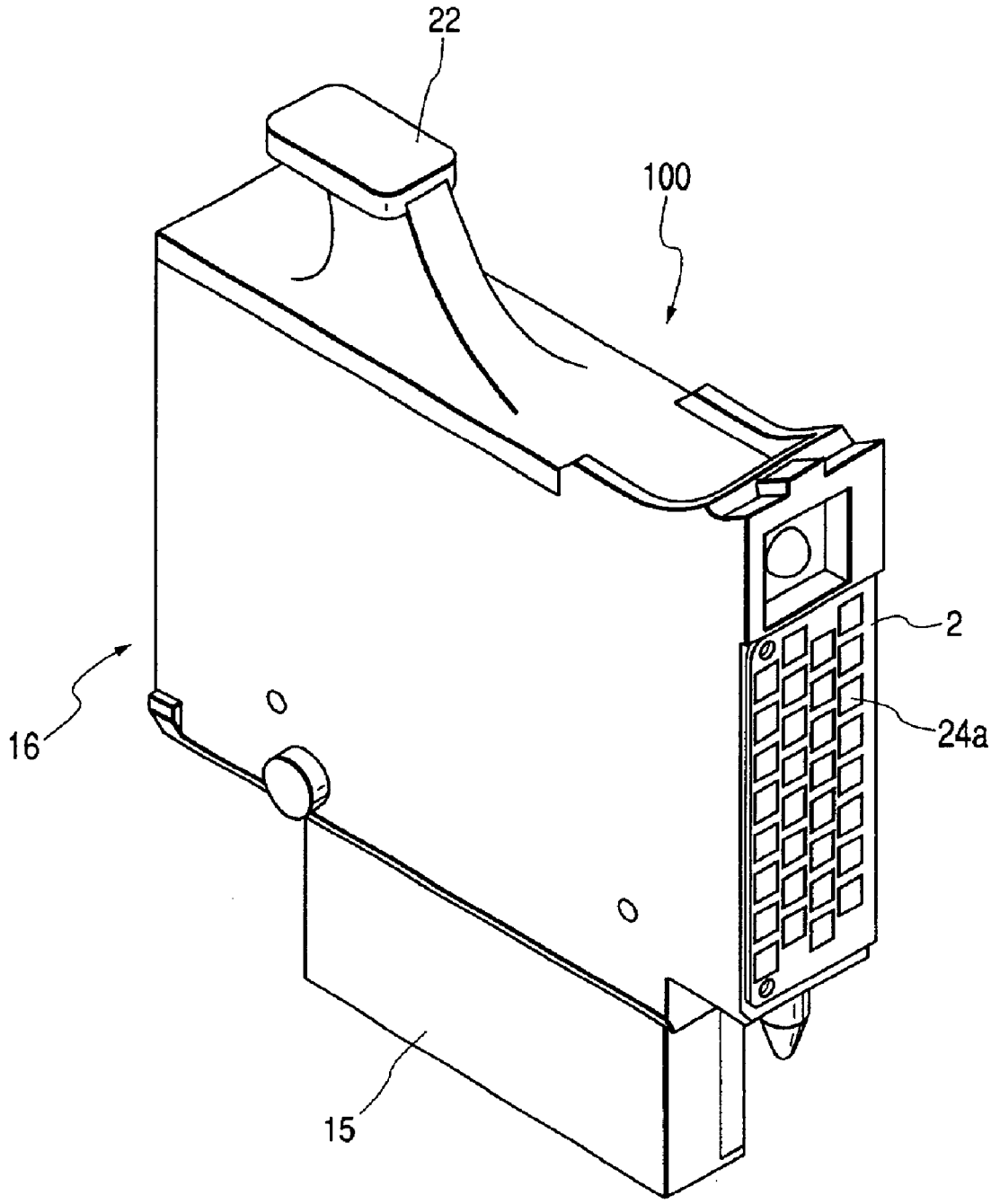
FIG. 3 is an external perspective view of the liquid discharge recording head seen from a side thereof.
Figure 4:
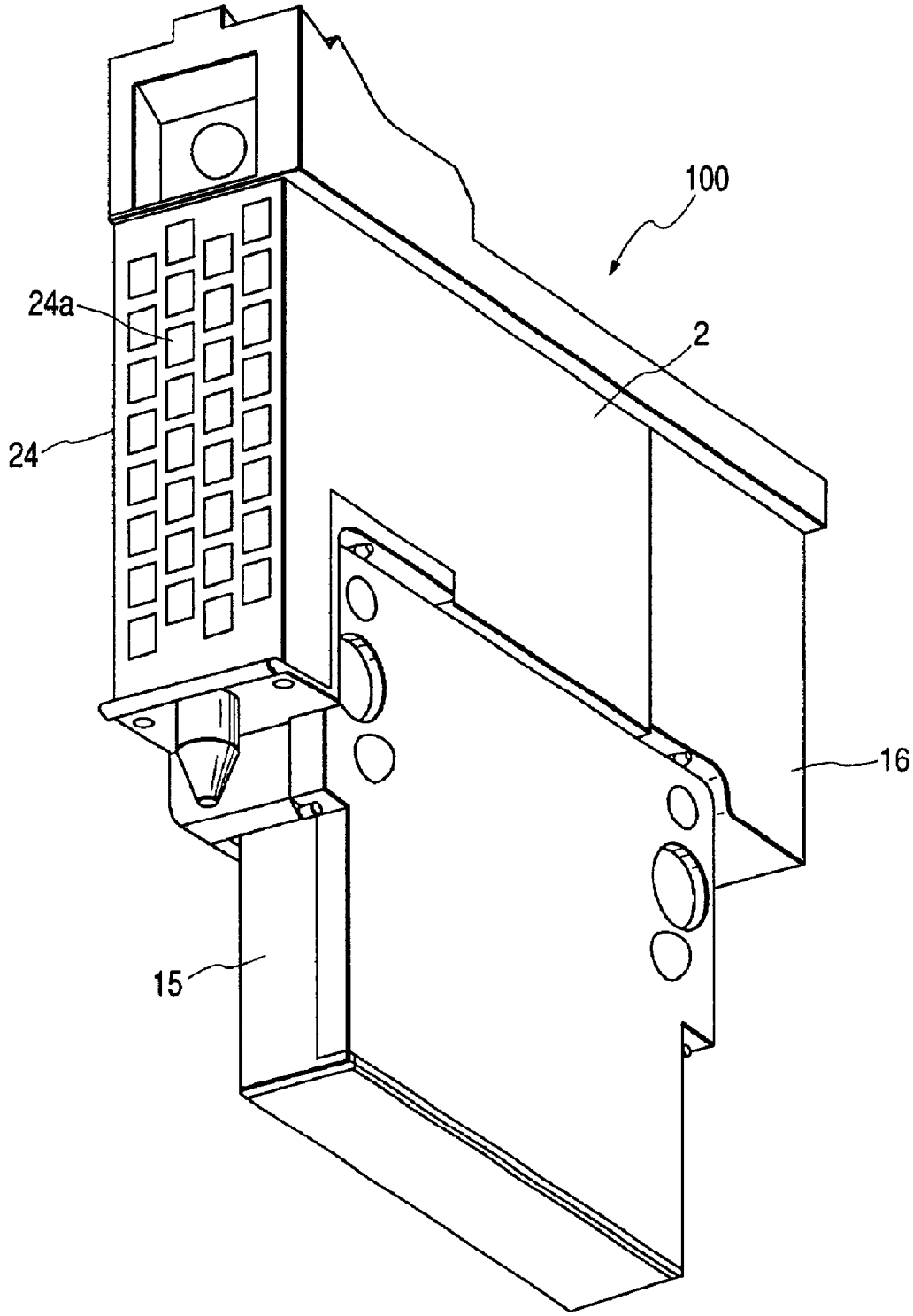
FIG. 4 is an external perspective view of the liquid discharge recording head seen from another side thereof.
Figure 5:
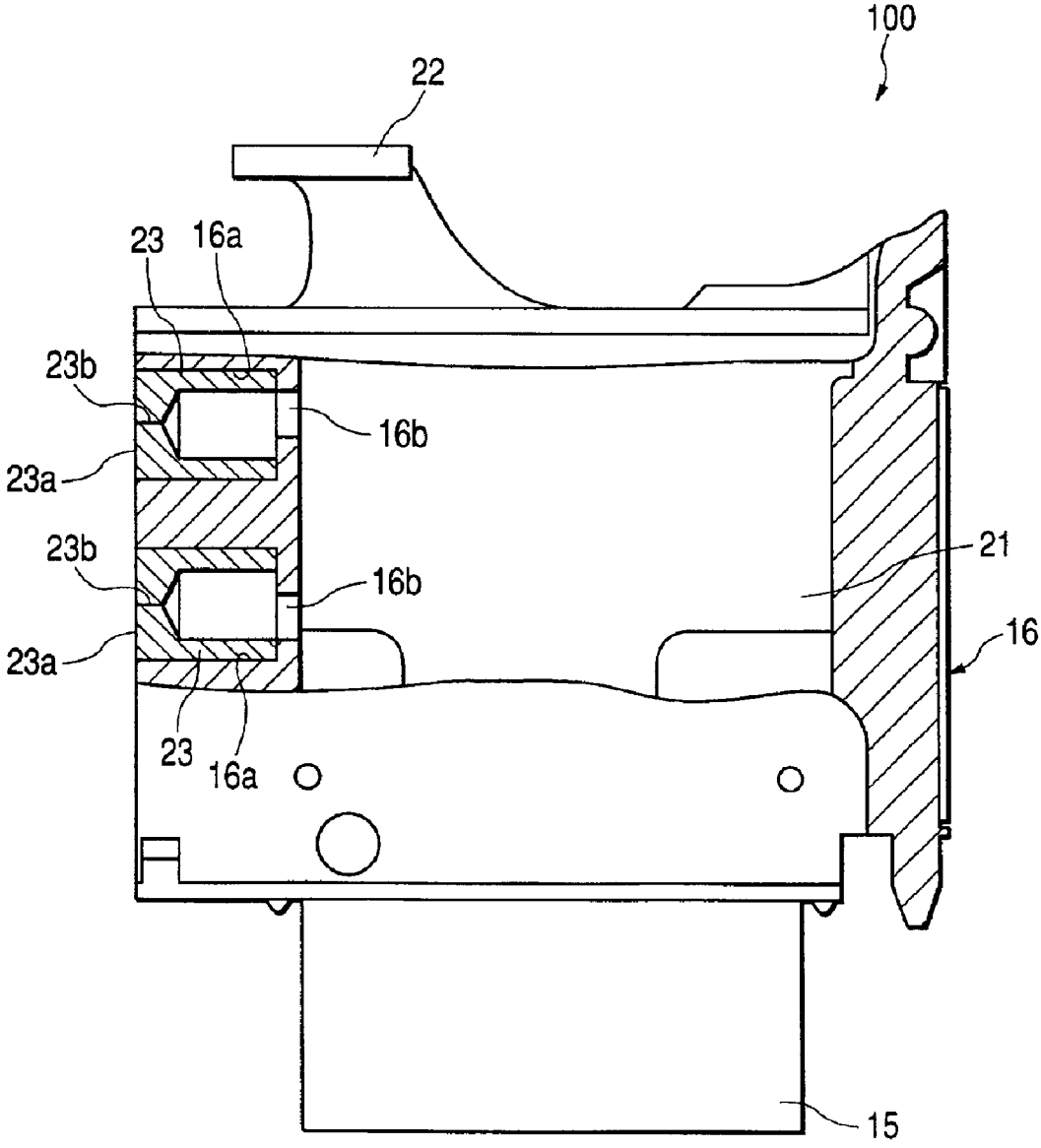
FIG. 5 is a partial cross-sectional view of the liquid discharge recording head.
Figure 6A:
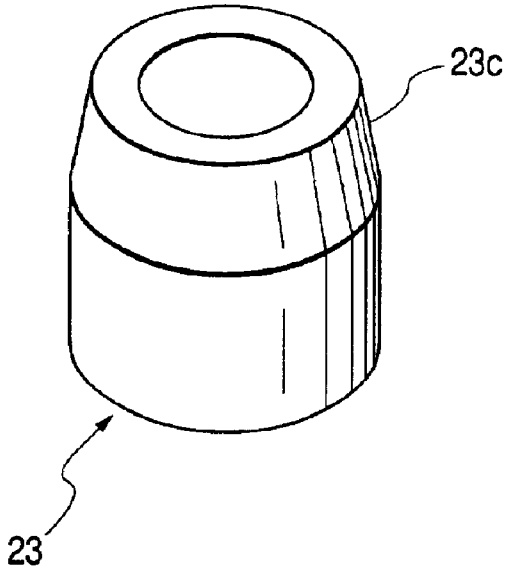
FIGS. 6A and 6B are external perspective views showing an example of joint rubber.
Figure 7:
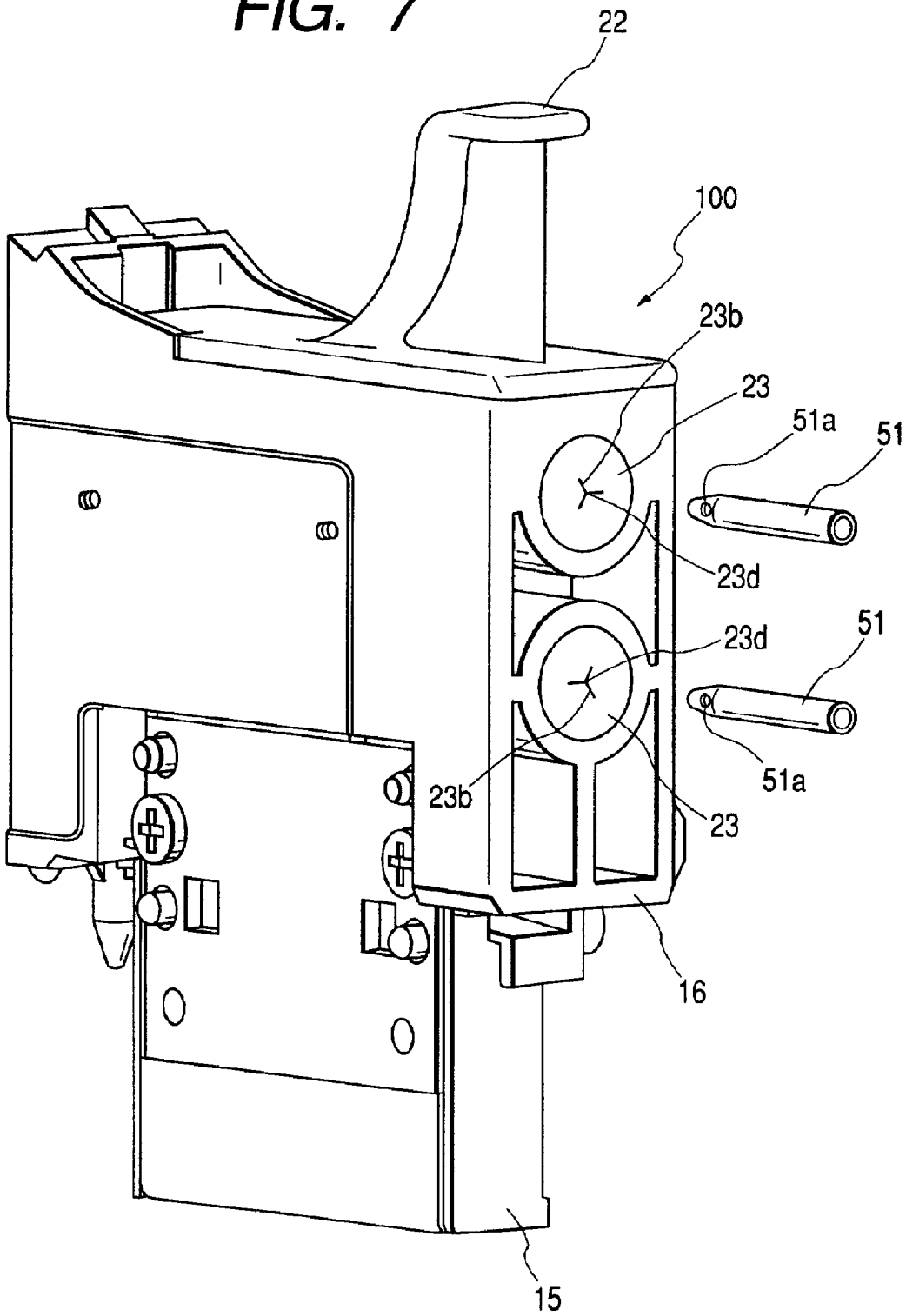
FIG. 7 is an external perspective view for explaining an inserting operation of a needle member into the liquid discharge recording head.
Figure 8A:
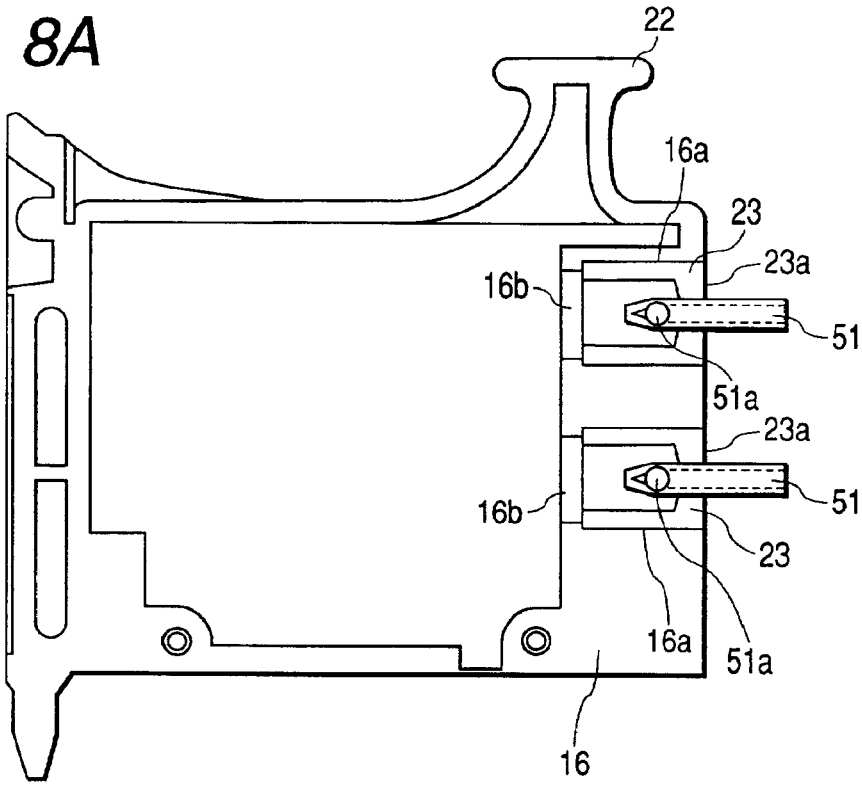
FIGS. 8A and 8B are partial cross-sectional views respectively showing an inserted sate of the needle member in the liquid discharge recording head and a non-inserted state of the needle member in the liquid discharge recording head.
Figure 8B:
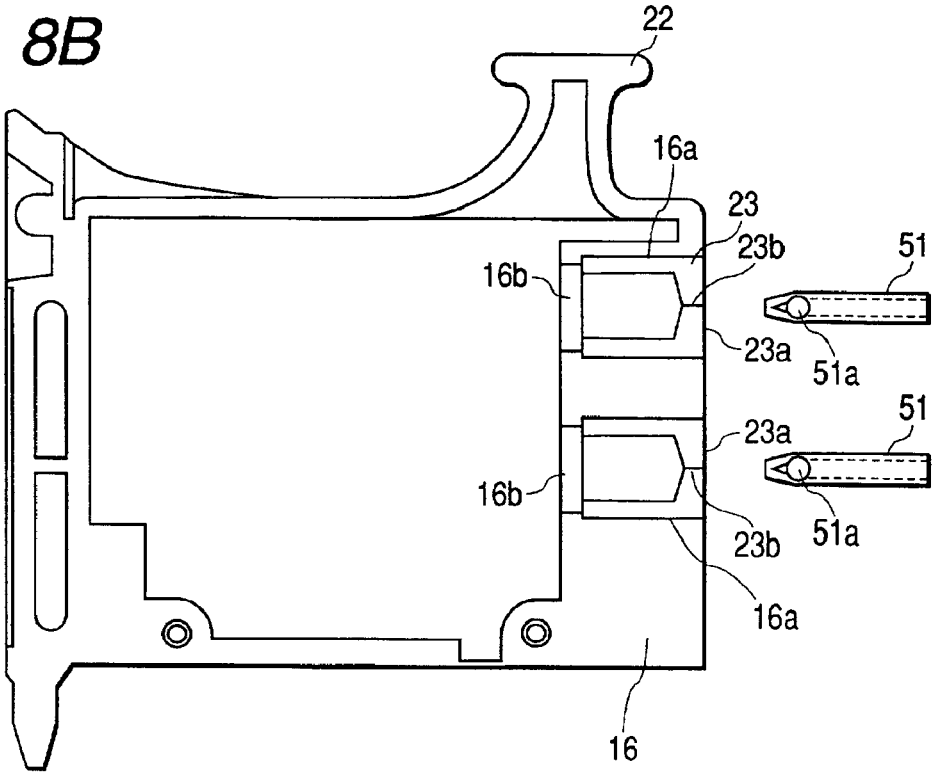
Figure 9:
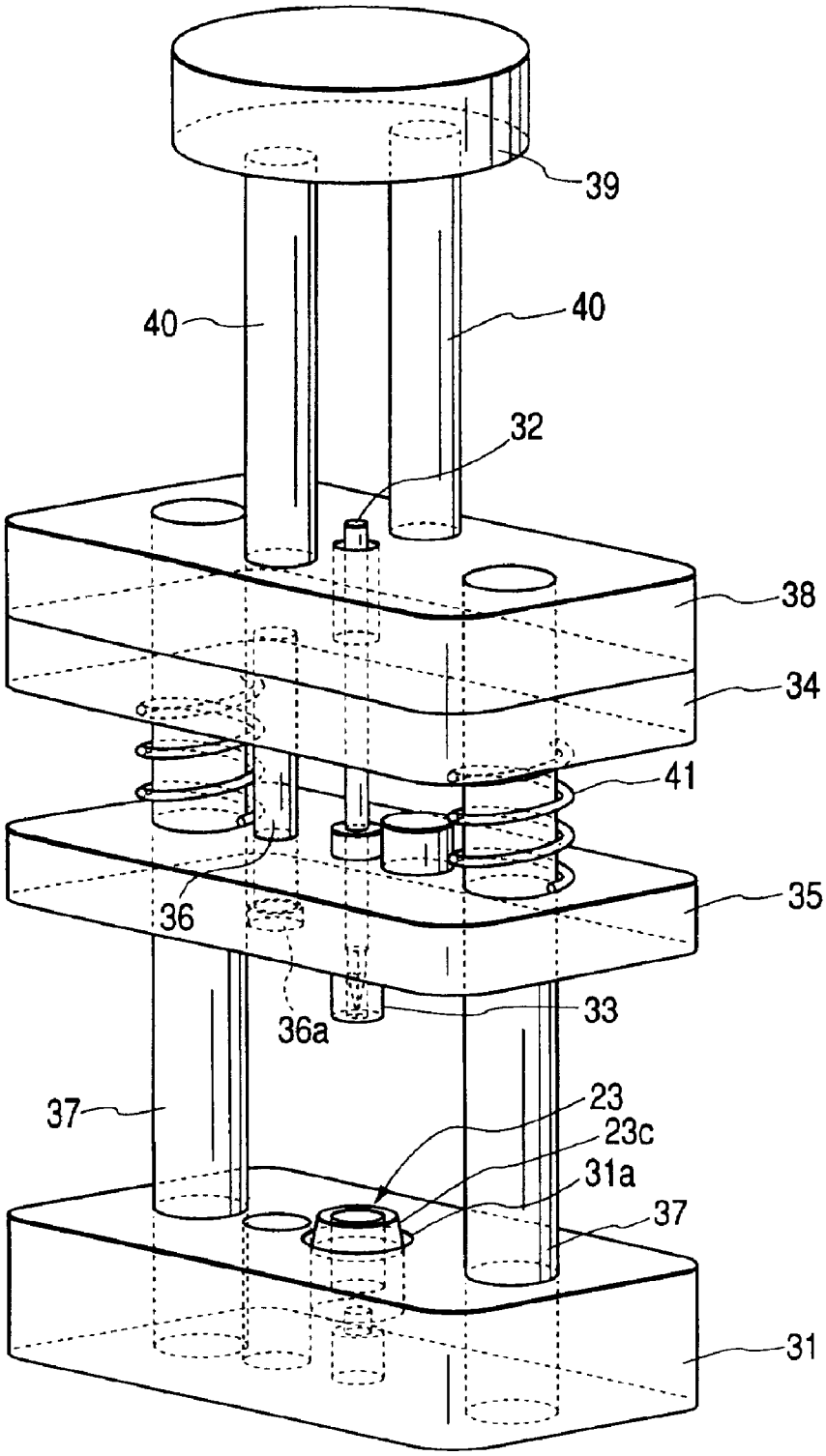
FIG. 9 is an external perspective view showing an example of a working apparatus for forming a fissure hole in the stopper member.
Figure 10:
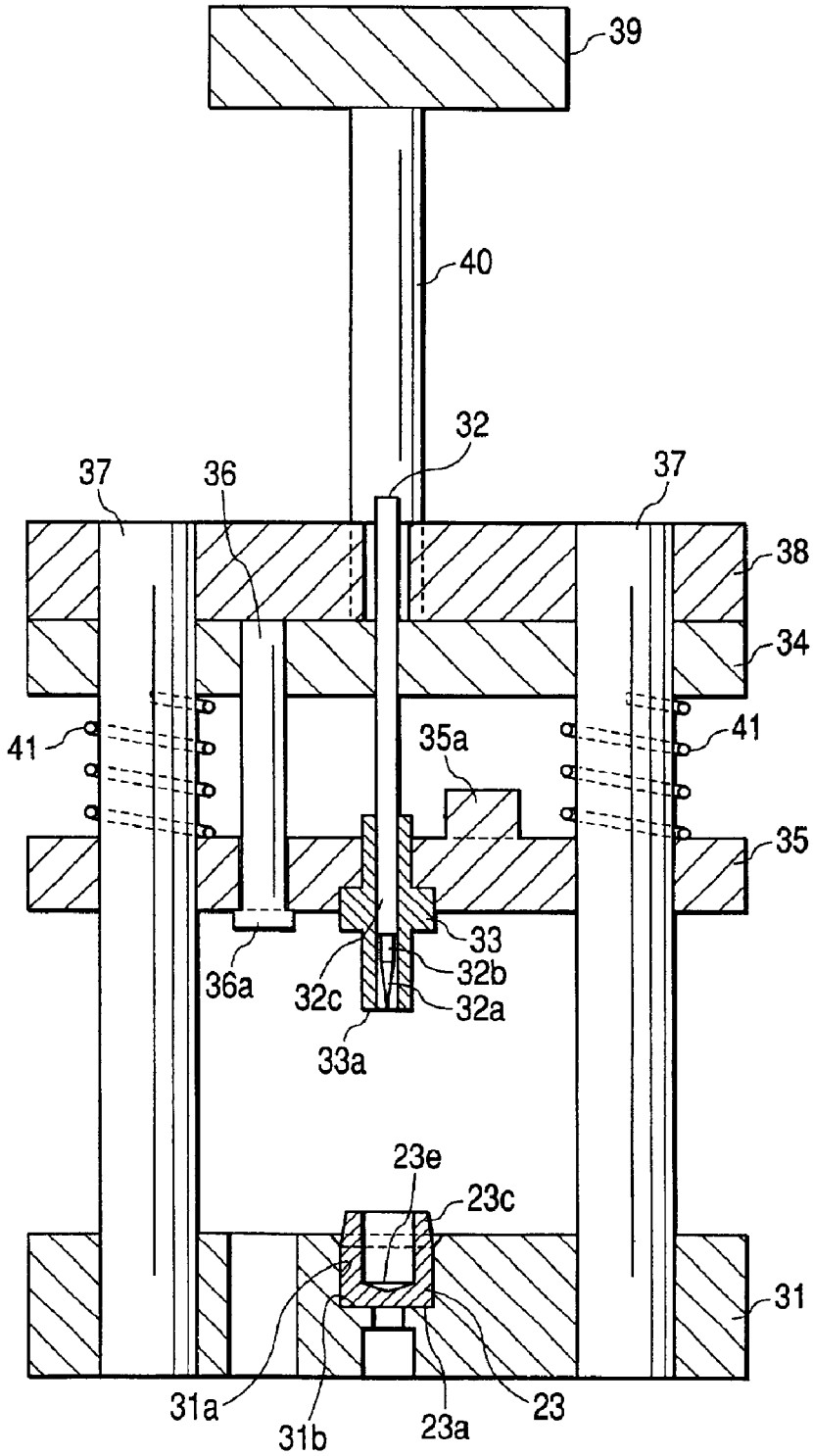
FIG. 10 is a cross-sectional view showing a retracted state of a punch member in the fissure hole forming apparatus shown in FIG. 9.
Figure 11:
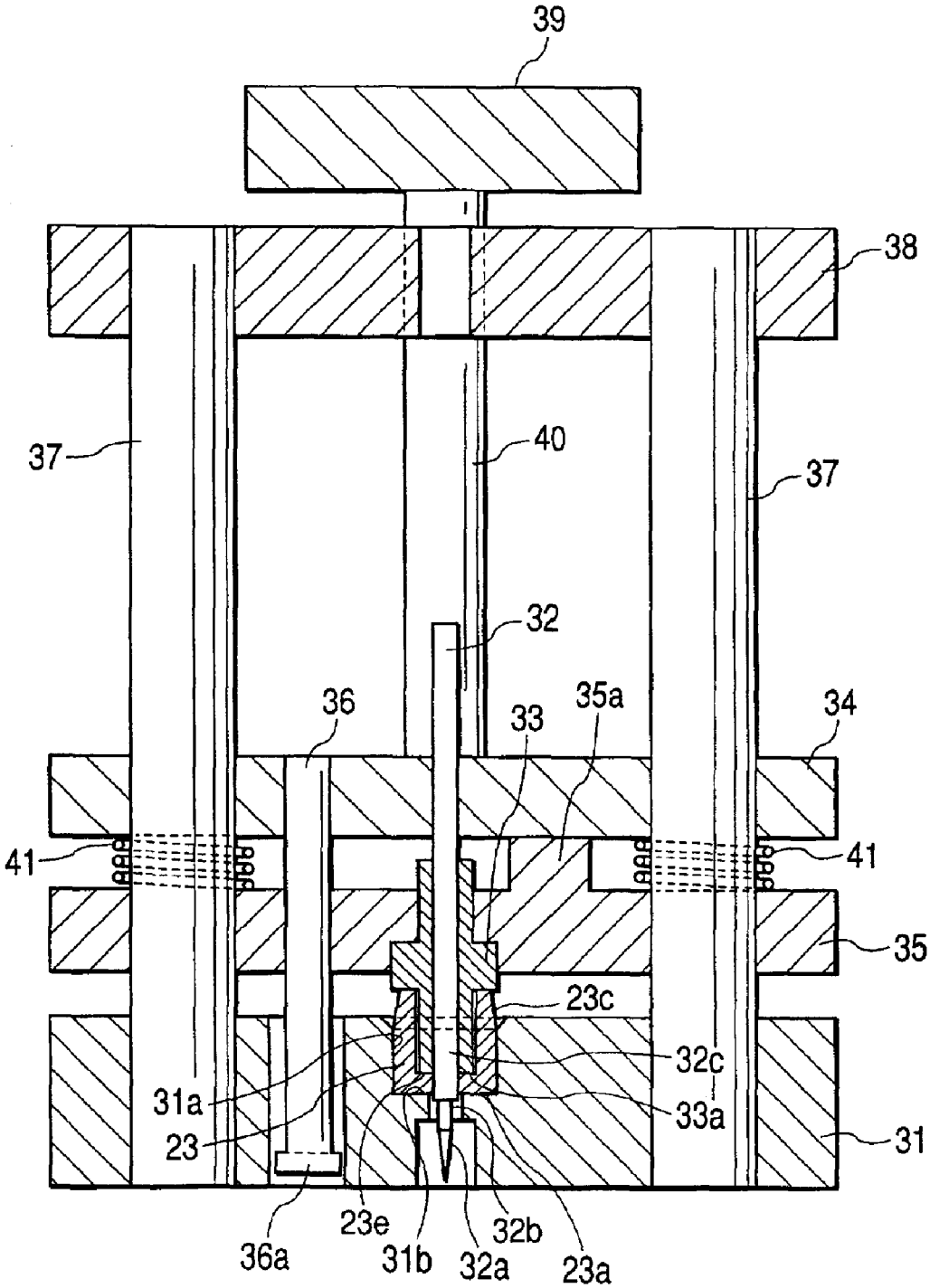
FIG. 11 is a cross-sectional view showing an entered state of the punch member in the fissure hole forming apparatus shown in FIG. 9.
Figure 12:
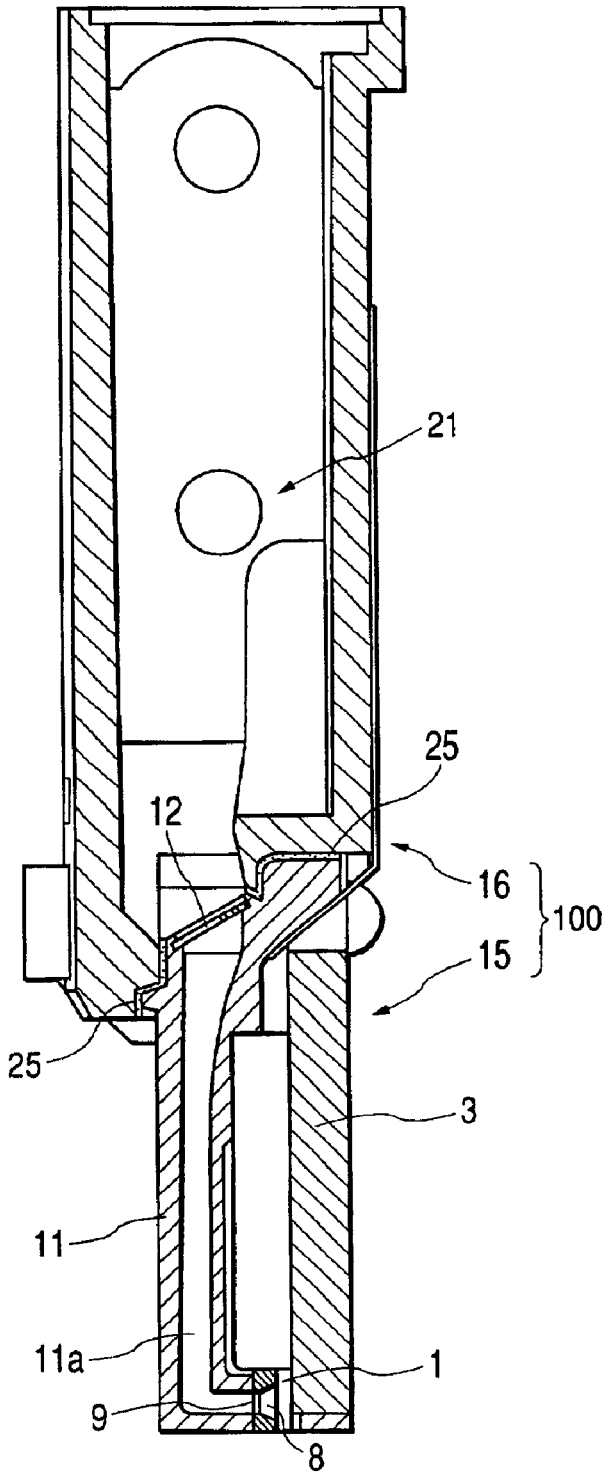
FIG. 12 is a cross-sectional view of the liquid discharge recording head.
Figure 13:
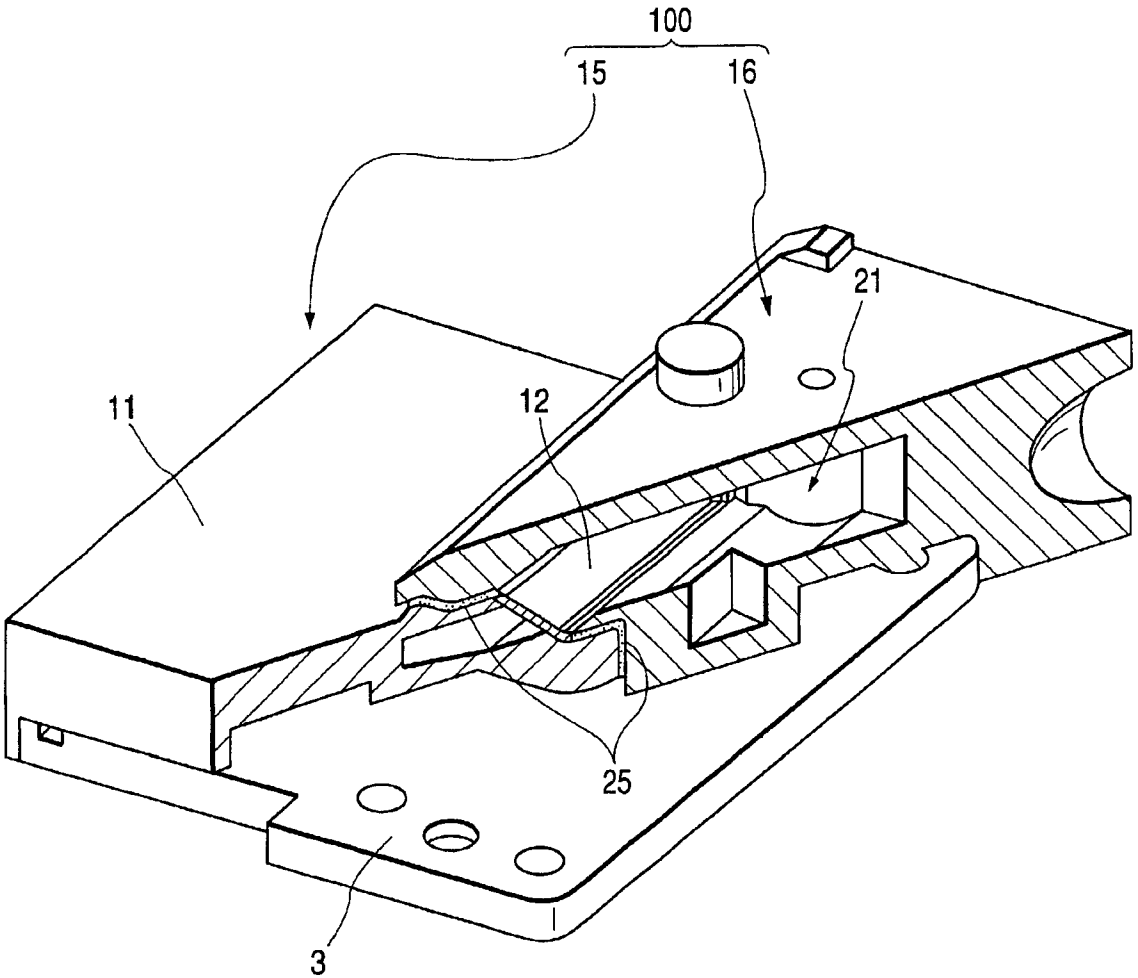
FIG. 13 is a partial cross-sectional view of the liquid discharge recording head.
Figure 14:
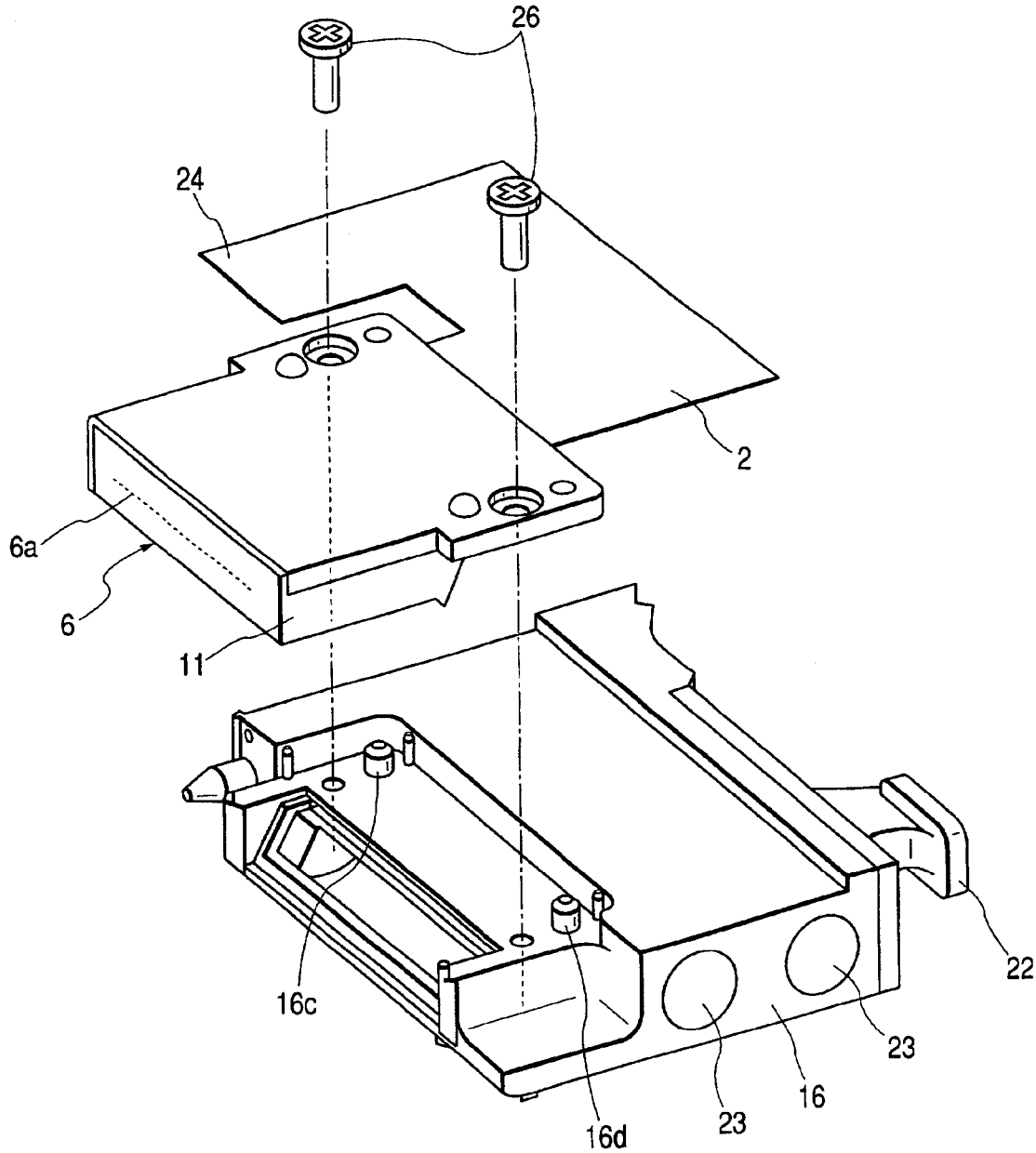
FIG. 14 is an exploded perspective view showing the configuration of the liquid discharge recording head.
Figure 15:
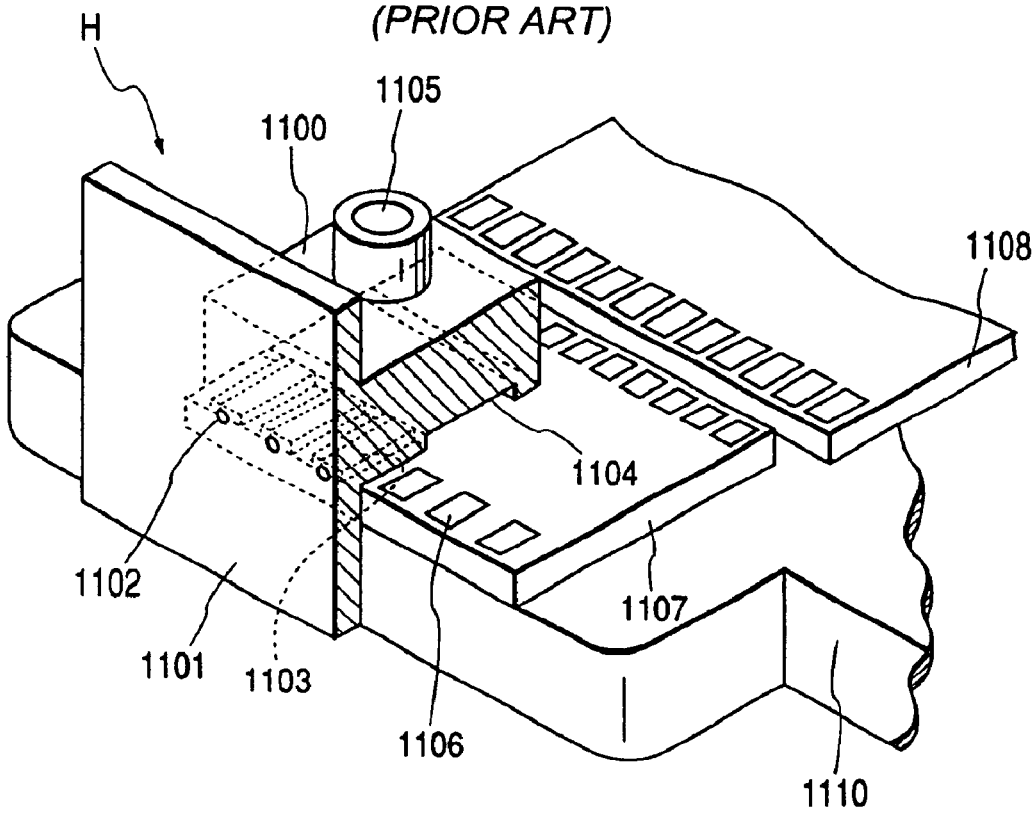
FIG. 15 (PRIOR ART)
FIG. 15 is a schematic perspective view showing the configuration in a part of a conventional liquid discharge recording head.
Figure 16:
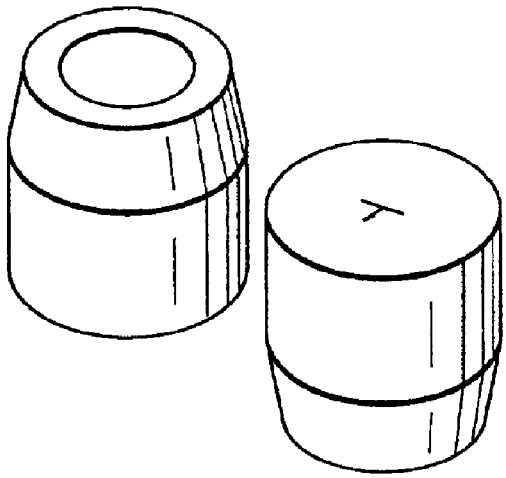
FIGS. 16 and 17 are external perspective views showing examples of joint rubber.
Figure 17:
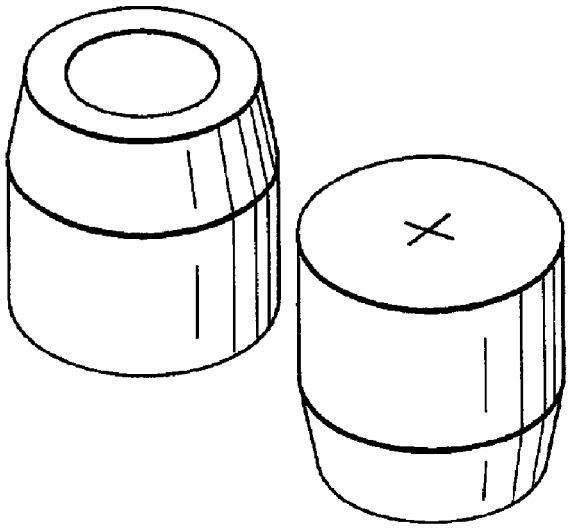
Figure 18:
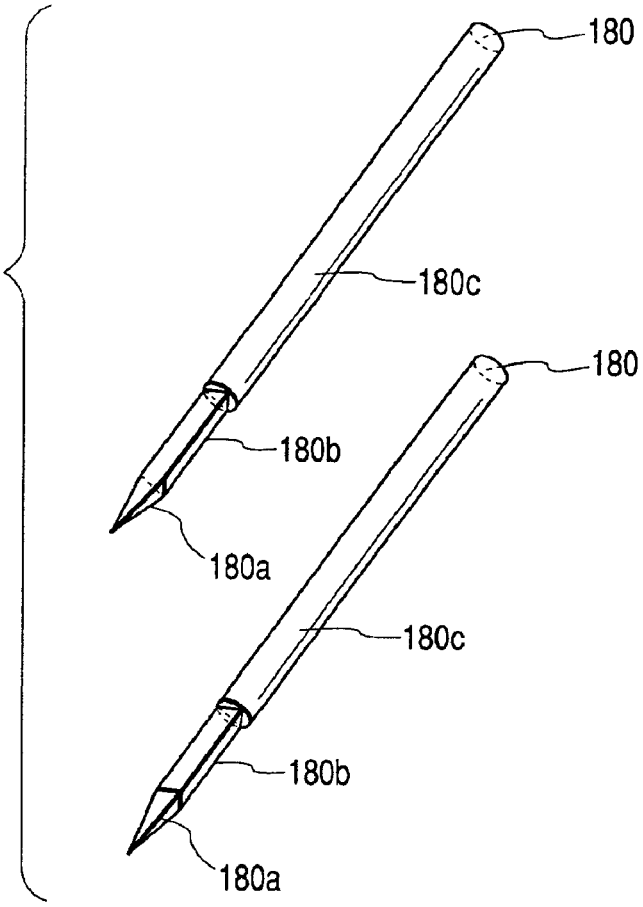
FIGS. 18 and 19 are external perspective views showing parts of a working apparatus for forming the fissure hole in the stopper member.
Figure 19:
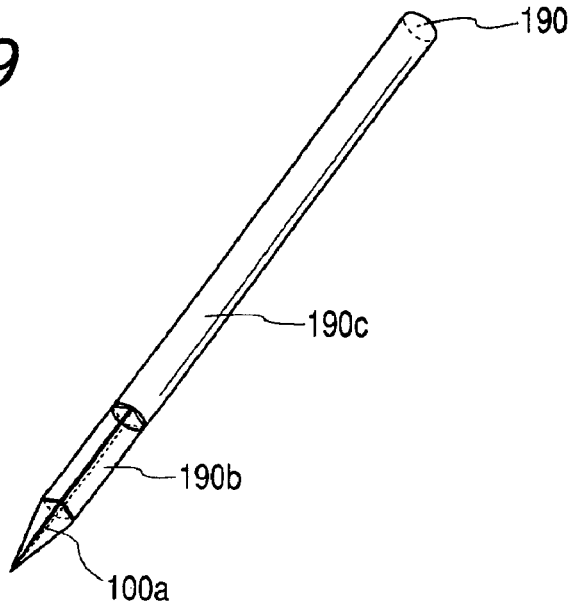

FIG. 1 is a schematic perspective view showing a configuration of a liquid droplet discharging portion of a liquid discharge recording head constituting an embodiment of the present invention; FIG. 2 is a partially cut-off perspective view of the liquid droplet discharging portion shown in FIG. 1; FIG. 3 is an external perspective view of the liquid discharge recording head seen from a side thereof; FIG. 4 is an external perspective view of the liquid discharge recording head seen from another side thereof; FIG. 5 is a partial cross-sectional view of the liquid discharge recording head; FIGS. 6A, 6B, 16 and 17 are external perspective views of a stopper member applicable to the liquid discharge recording head of the present embodiment; FIG. 7 is an external perspective view for explaining an inserting operation of a needle member into the liquid discharge recording head; FIGS. 8A and 8B are partial cross-sectional views showing inserting and extracting operation of the needle member into or from the liquid discharge recording head; FIG. 9 is an external perspective view showing an example of a working apparatus for forming a fissure hole in the stopper member; FIGS. 10 and 11 are cross-sectional views showing the functions of the apparatus shown in FIG. 9; FIG. 12 is a cross-sectional view of the liquid discharge recording head; FIG. 13 is a partial cross-sectional view of the liquid discharge recording head; FIG. 14 is an exploded perspective view showing the configuration of the liquid discharge recording head; and FIGS. 18 and 19 are external perspective views showing parts of a working apparatus for forming the fissure hole in the stopper member.

The fissure hole formed in the stopper member of the present invention has fissures in not less than three directions from the crossing center of the fissures. It is preferred, in order to maintain the sealing ability of the stopper member, that the distance from the front end of each fissured section to the base portion thereof substantially coincides with the radius (½ of external diameter) of the needle member, namely that the diameter of an imaginary circle passing through all the base points of the fissured sections substantially coincides with the external diameter of the needle member.

However, with an increase in the number of fissured sections in the joint rubber, the insertion of the needle member is facilitated, but the width of the base portion of each fissured section becomes smaller and the distance from the front end of each fissured section to a straight line connecting the base portions of two adjacent fissures constituting each fissured section becomes longer. As a result, the front end portion of the fissured section becomes easily bendable and may be folded by the repetition of the inserting and extracting operations of the needle member. Therefore, in order to maintain satisfactory sealing ability of joint rubber 23, to achieve smooth opening and closing of the fissured sections at the insertion and extraction of the needle 51 and to achieve satisfactory durability of the fissure hole, it is preferable to set the length of the fissured section from the front end to the base portion thereof in such a manner that the elastic recovery force of the fissured section becomes larger than the frictional force generated between the fissured section and the needle member at the insertion or extraction thereof.

More specifically, in order to increase the elastic recovery force of the fissured section while not deteriorating the inserting ability for the needle member, the distance from the front end of the fissured section to the base portion thereof is preferably smaller than the radius of the needle member.

Figure 6B:
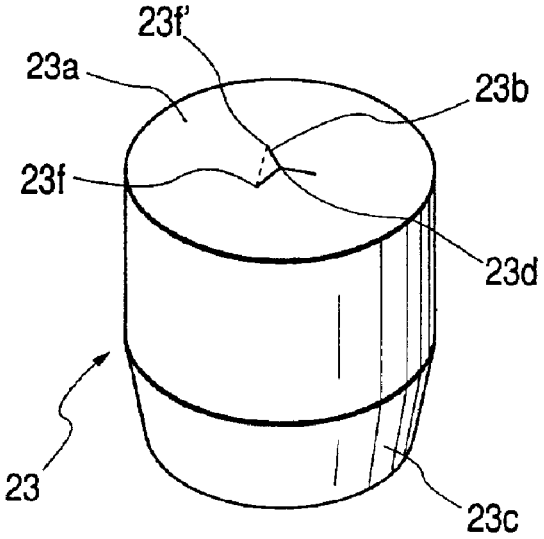

In the preferred configuration shown in FIG. 6B, attained by the present inventors in consideration of the balance of the sealing ability and the inserting ability, the fissure hole has a substantially Y-shape (a crossing angle of 120° between the adjacent fissured sections), a circle passing through the base portions of all the fissured sections has the same diameter as the external diameter of the needle member, and the shortest distance from the front end (crossing center 23*d* of the fissures) of the fissured sections formed by the substantially Y-shaped fissure hole to a straight line connecting the two base portions (23*f*, 23*f*') of such fissured section corresponds to ½ of the radius of the needle member.

Therefore, in consideration of the durability and the sealing ability, there is preferred a fissure hole having fissures in three to five directions from the crossing center of the fissures. More preferably, the fissure hole has fissures in three or four directions, and, most preferably, the fissure hole has fissures in three directions. Further, among the fissure holes having fissures in three directions from the crossing center of the fissures, a fissure hole of substantially Y-shape, in which the three fissured sections are divided equally, is most excellent in the sealing ability, durability, and inserting and extracting ability.

In the following, the configuration of the liquid discharge recording head of the present embodiment will be explained.

A liquid discharge recording head 100 of the present embodiment, shown in FIGS. 3 and 4, is provided with a head chip 15 constituting a liquid discharge unit for discharging liquid droplets, a print liquid reservoir (second common liquid chamber) for containing print liquid to be supplied to the head chip 15, and a frame member 16 constituting a frame unit for serving as a casing for holding the head chip 15. The head chip 15 is provided with a liquid droplet discharge portion for discharging liquid droplets according to a print signal from a nozzle array consisting of an array of discharge ports (nozzles) for discharging liquid droplets, and a sheet-shaped wiring member, such as a flexible cable or a TAB, constituting electrical wirings for the print signal to be exchanged with the main body of a liquid discharge recording apparatus in which the liquid discharge recording head 100 is mounted.

In the following, an example of the configuration of the head chip 15 will be explained.

As shown in FIGS. 1 and 2, the head chip 15 is provided with a base plate 3, on which a strip-shaped heater board 1 extending in a direction is fixed. The heater board 1 is obtained by forming discharge heaters 1*a*, which are electrothermal converting members constituting energy generating elements for generating energy for discharging the print liquid from the discharge ports, and wirings for supplying the discharge heaters 1*a* with electrical power on a silicon substrate by the on-silicon film forming technology. On the base plate 3, there is adjoined a wiring board 2 constituting wirings to the heater board 1 and executing electrical contact to the main body of the liquid discharge recording apparatus. The wiring board 2 can be composed, for example, of a PWB board bearing copper or nickel wiring patterns on a glass-epoxy resin board, a TAB or a FPC bearing wiring patterns on a flexible film or the like. The heater board 1 and the wiring board 2 are electrically connected, for example, by wire bonding or lead bonding.

The base plate 3 is composed, for example, of aluminum or ceramics, and serves as a substrate supporting the heater board 1. The base plate 3 also serves as a heat sink for dissipating the heat generated by the driving of the liquid discharge recording head 100 from the heater board 1, thereby cooling the same. A face of the base plate 3 supporting and adjoined with the heater board 1 is provided with a groove 3*d*, which extends along the longitudinal direction of the heater board 1.

The heater board 1 is adjoined, in order to efficiently dissipate the heat accumulated therein, to the base plate 3 with adhesive of satisfactory thermal conductivity. Such adhesive is composed, for example, of silver paste containing silver powder in epoxy resin, and the heater board 1 is die bonded with the silver paste to the base plate 3. Since the silver paste is poured into the groove 3*d* of the base plate 3 along the longitudinal direction thereof, it is possible to easily control the coating area of the silver paste and to prevent overflow of the silver paste from the adjoined portion between the base plate 3 and the heater board 1, whereby waste of silver paste can be suppressed.

Since the silver paste is generally composed of epoxy adhesive, it is necessary to harden the silver paste by thermal reaction. As the epoxy adhesive becomes less viscous during heating, the epoxy adhesive increases flowability and completely fills the groove 3*d*.

Consequently, the groove 3*d* is preferably provided within an area of the base plate 3 where the heater board 1 is placed, but, if the groove 3*d* is extended to both ends of the base plate 3, the excessive silver paste eventually coated over the desired amount flows out along the longitudinal direction of the groove 3*d* and is prevented from flowing out from the front face of the liquid discharge recording head 100.

Also, the wiring board 2 provided on the base plate 3 is positioned behind the heater board on the base plate 3 and adjoined thereto, for example, with adhesive.

On a surface of the heater board 3 at the side of the discharge heaters 1*a*, there is adjoined a top plate 5 across partitions of plural flow path grooves 7 constituting the liquid flow paths for the print liquid and a wall portion constituting a first common liquid chamber 8 communicating with the liquid path grooves 7. Therefore, there are formed, on the heater board 1, the flow path grooves 7 separated by the partitions formed on the heater board 1 and constituting the nozzles, and such liquid flow paths for the print liquid and the the upper wall portion of the first common liquid chamber 8 communicating with such liquid flow paths. The first common liquid chamber 8 communicates with the flow path grooves 7 and contains the print liquid to be supplied thereto. In a part of the top plate 5, there is formed a supply aperture 9 constituting a receiving aperture for guiding the print liquid, supplied from an unrepresented tank, through a second common liquid chamber 21 (to be explained later in relation to FIG. 5) to the first common liquid chamber 8. The top plate 5 is formed, for example, with silicon, silicon nitride, glass or ceramics by anisotropic etching or by molding.

The flow path grooves 7 are provided on the heater board 1 in such a manner that the arrangement of such flow path grooves 7 matches the arrangement of the discharge heaters 1*a*. The plural flow path grooves 7 are formed on the heater board 1 by forming a photosensitive resin layer such as epoxy resin on the upper surface of the heater board 1 and by executing a photolithographic step such as etching to form partition walls between the adjacent flow path grooves 7.

After preparing the heater board 1 and the top plate 5, the top plate 5 and the heater board 1 are adjoined to sandwich the flow path grooves 7 therebetween, whereby the top apertures of the flow path grooves 7 are closed by the top plate 5 and the nozzles serving as the liquid flow paths consisting of the flow path grooves 7 are formed between the heater board 1 and the top plate 5. Such adjoining of the top plate is generally achieved with adhesive having satisfactory resistance to the print liquid employed for recording.

The adjoining of the heater board 1 and the top plate 5 need not necessarily be executed after the die bonding of the heater board 1 to the base plate 3 as explained in the foregoing, but it is also possible to execute the die bonding of the heater board 1 and the base plate 3 after the adjoining of the top plate 5. In the present embodiment, for the purpose of clarity, there will be explained a process of executing the adjoining of the top plate 5 after the die bonding step.

Also, the flow path grooves 7 need not necessarily be formed on the heater board 1 as explained in the foregoing, but may also be formed on the top plate 5 by forming the partitions with photosensitive resin on the lower face thereof. In an embodiment in which the flow path grooves 7 are formed on the upper face of the heater board 1, the flow path grooves 7 and the discharge heaters 1*a* are so provided that they are precisely aligned by the semiconductor film forming technology. On the other hand, in an embodiment in which the flow path grooves 7 are formed on the lower face of the top plate 5, the flow path grooves 7 and the discharge heaters 1*a* are so provided that they are precisely aligned by mechanical alignment.

On the front end faces of the heater board 1 and the top plate 5, there is adjoined an orifice plate 6 provided with a desired number of discharge ports 6*a* for discharging the print liquid in the flow path grooves 7 toward the recording medium. The orifice plate 6 is composed of a plate of metal such as stainless steel (SUS), Ni, Cr or Al, a resin mold or a resin film such as of polyimide, polysulfone, polyethersulfone, polyphenylene oxide, polyphenylene sulfide or polypropylene, silicon or ceramics.

The heater board 1 and the top plate 5 are maintained in close contact by a press spring 10, which presses the upper face of the top plate 5 approximately at the center in the shorter side thereof. More specifically, square U-shaped bent portions 10*a* provided on both ends of the press spring 10 (one of the bent portions 10*a* being omitted in FIG. 2) are inserted into notches 3*a* provided on the base plate 3, and fingers on the end of the bent portions 10*a* are to engage on the lower face of the base plate 3. Thus, a pressing force generating portion 10*c* of the press spring 10 presses the upper face of the top plate 5, whereby the top plate 5 and the heater board 1 are pinched between the press spring 10 and the base plate 3. Thus, the heater board 1 and the base plate 3 receive the set load of the press spring 10 in the adjoining (laminating) direction of the two, and the adjoining of the two is maintained by a force of the physical load of the press spring 10 in addition to the binding force of the adhesive. There can also be adopted a configuration not employing the physical load by the press spring 10, and, in such configuration, the adjoining force between the heater board 1 and the base plate 3 is solely determined by the binding force of the adhesive.

The head chip 15 is also provided with a chip tank 11 having a print liquid supply path 11*a* for guiding the print liquid from the second common liquid chamber, positioned upstream in the liquid discharge recording head 100, to the supply aperture 9. The chip tank 11 is provided with a front plate portion 11*b*, which serves to hold the orifice plate 6 by being adjoined thereto in an area thereof outside the discharge ports 6*a* and to support the orifice plate 6 in such a manner that the orifice plate 6 can sufficiently stand the pressing or pulling force applied in the capping operation of the discharge ports 6*a* by an unrepresented capping member provided in the main body of the recording apparatus.

The orifice plate 6 is adjoined, for example, with adhesive based on epoxy resin to the front end face 1*b* of the heater board 1 and the front and face 5*b* of the top plate 5. FIG. 2 shows a state prior to the adjoining of the orifice plate 6, while FIG. 1 shows a state after the adjoining thereof.

The chip tank 11 and the top plate 5 are adjoined, as shown in FIGS. 2 and 12, in such a manner that the print liquid supply path 11*a* of the chip tank 11 communicates with the supply aperture 9 of the top plate 5. The adjoining of the chip tank 11 and the top plate 5 is achieved by mutual pressing of the adjoining faces thereof, and the periphery of the adjoining faces is sealed in a complementary manner with filler (not shown).

In the following, an example of the configuration of the frame member 16 will be explained.

As shown in FIGS. 3 to 5 and 12 to 14, the frame member 16 serves as a casing for the liquid discharge recording head 100. Inside the frame member 16, there is provided a second common liquid chamber 21 capable of containing the print liquid of a desired amount and adapted to store the contained print liquid either temporarily or until it is exhausted (cf. FIG. 5).

As shown in FIGS. 12 and 13, a porous member 12 is provided at the boundary between the chip tank 11 and the second common liquid chamber 21. The porous member 12 is provided with fine holes for trapping (collecting) impurities in the print liquid. In the present embodiment, the porous member 12 is adjoined by fusion to the chip tank 11. Therefore, no gas can enter the interior of the liquid discharge recording head 100 from the adjoining portion between the chip tank 11 and the porous member 12.

In such a configuration of the liquid discharge recording head 100, the print liquid stored in the second common liquid chamber 21 is supplied through the porous member 12 to the head chip 15, and further through the print liquid supply path 11*a* of the chip tank 11 and the first common liquid chamber 8 of the top plate 5 to the nozzle portion (flow path grooves 7).

In the upper part of the liquid discharge recording head 100, there is provided a grip 22, which is used as a hand grip in mounting or detaching the liquid discharge recording head 100 on or from the carriage (not shown) of the main body of the liquid discharge recording apparatus. In the main body of the liquid discharge recording apparatus, there are provided conveying means for conveying the recording medium such as paper in a direction, and a carriage reciprocated in a direction substantially perpendicular to the conveying direction of such recording medium.

In the following, an explanation will be given of the joint rubber constituting the stopper member, in an example where the fissure hole has a Y-shaped form.

As shown in FIG. 5, on the wall of the frame member 16, there are formed plural cylindrical hole portions 16*a* in which joint rubber 23 constituting the stopper member is to be inserted. The joint rubber 23 has a substantially cylindrical external shape, and constitutes the supply aperture for the print liquid from the exterior of the liquid discharge recording head 100 to the second common liquid chamber 21. The joint rubber 23 is provided in advance at the center thereof, as shown in FIGS. 5, 6A and 6B, with a Y-shaped fissure hole 23*b* prior to the insertion of a needle 51 of the main body of the liquid discharge recording apparatus, as will be explained later with reference to FIG. 7. The fissure hole 23*b* has a so-called Y-shape in a direction perpendicular to the direction of depth of such hole. The joint rubber 23 is pressed into the cylindrical hole portion 16*a* formed in the frame member 16 with an internal diameter smaller than the external diameter of the joint rubber 23. Consequently, the cross-sectional size of the joint rubber 23 in a direction perpendicular to the central axis thereof is larger than the cross-sectional shape in a direction perpendicular to the direction of depth of the cylindrical hole portion 16*a*. Also, in the joint rubber 23, a front end portion 23*c* thereof to be pressed into the cylindrical hole portion 16*a*, is tapered in order to facilitate insertion therein.

For the supply of the print liquid from the tank provided in the main body of the liquid discharge recording apparatus to the liquid discharge recording head 100, front ends of needles 51 provided as hollow needle-shaped liquid supply members in the main body of the liquid discharge recording apparatus are inserted, as shown in FIG. 7, into the joint rubbers 23. Then, as shown in FIG. 8A, the print liquid is supplied from the tank in the main body of the liquid discharge recording apparatus to the second common liquid chamber 21 through the needles 51 inserted into the joint rubbers 23.

In the joint rubber 23 of the aforementioned configuration, the peripheral portion of the fissure hole 23*b* receives a compression load from the external periphery of the joint rubber 23, so that the fissure hole 23*b* is in a closed state to tightly close the interior of the second common liquid chamber 21 in the non-inserted state of the needle 51 in the joint rubber 23 as shown in FIG. 8B.

On the other hand, when the needle 51 is inserted into the joint rubber 23 as shown in FIG. 8A, a gripping force (compression force from the external periphery) is applied on the needle 51 by the joint rubber 23, so that the jointing portion of the joint rubber 23 and the needle 51 can be completely sealed except for the hollow portion of the needle 51.

As explained in the foregoing, by forming the fissure hole 23*b* in the joint rubber 23, the fissure hole 23*b* is deformed by separation into three directions at the insertion and extraction of the needle 51 and is retracted toward the external periphery of the joint rubber 23. The sliding load of the needle 51 is significantly reduced in comparison with the configuration of inserting a sharp needle to pierce the rubber, and the operability during replacement of the liquid discharge recording head 100 can thus be improved.

Also, even if the center of the needle 51 is inserted eccentrically with respect to the center 23*d* of the joint rubber 23, at least one of the three fissured sections receives, in the vicinity of the fissure hole 23*d*, the piercing pressure of the front end of the needle 51 and is depressed from the end face 23*a* of the joint rubber 23, whereby the inserting resistance applied to the front end of the needle 51 is reduced. When the needle 51 is further inserted from such state, it receives a repulsive force based on the elastic recovery force of the depressed and retracted fissured section, whereby a load from such fissured section is applied onto the needle 51 toward the center 23*d* of the joint rubber 23. Therefore, the needle 51 is thereafter inserted toward the second common liquid chamber 21 while being guided toward the center 23*d* of the joint rubber 23. Thus the needle 51 can be smoothly inserted as other fissured sections are also retracted by the further advancement of the needle 51.

Therefore, even if the Y-shape of the fissure hole 23*b* of the joint rubber 23 is inclined in any direction in the state pressed into the frame member 16, the front end of the needle 51 is securely guided into the second common liquid chamber 21. Based on these facts, the penetrating operation of the needle 51 can be smoothly and securely executed without changing the dimensional precision or the assembling precision of the holding portion (not shown) for the needle 51, provided in the main body of the liquid discharge recording apparatus, needle 51, joint rubber 23 and frame member 16, whereby the liquid discharge recording head and the liquid discharge recording apparatus can be produced inexpensively.

In the liquid discharge recording head 100 of the present embodiment, the joint rubbers 23 are provided in two higher and lower positions of the frame member 16, and the joint rubber 23 in the lower position constitutes a supply path for supplying the print liquid from an unrepresented external liquid tank (hereinafter called the main tank) provided in the main body of the liquid discharge recording apparatus to the second common liquid chamber 21. The print liquid contained in the main tank is supplied into the second common liquid chamber 21 through a lateral hole 51*a* formed on a lateral face of the lower needle 51 and a lower communicating hole 16*b* in the frame member 16.

On the other hand, the other joint rubber 23 in the upper position constitutes an air extracting path for discharging the air accumulated in the second common liquid chamber 21 to the exterior, thereby controlling the negative pressure therein, and the air is discharged to the exterior of the second common liquid chamber 21 by air extracting means such as a pump through an upper communicating hole 16*a* and a lateral hole 51*a* of the upper needle 51. Consequently, the replenishing operation for the print liquid into the second common liquid chamber 21 can be controlled by increasing the negative pressure in the second common liquid chamber 21 by the aforementioned air extracting means.

An end of the aforementioned wiring board 2 constitutes a pad portion 24, as shown in FIGS. 4 and 14, on which there are formed contact pads 24*a* for exchanging the print signals between the head chip 15 and the main body of the liquid discharge recording apparatus.

In the following, an explanation will be given on the method for producing the joint rubber having the fissure hole of the present invention. First, a case where the fissure hole has a Y-shaped form will be explained.

After a member for constituting the joint rubber 23 is prepared, for example, by molding, the joint rubber 23 is prepared by forming a Y-shaped fissure hole in such member by a press process to be explained in the following. The joint rubber 23 thus prepared is pressed into the cylindrical hole portion 16*a* of the frame member 16.

FIG. 9 is an external perspective view showing an example of the fissure hole forming apparatus for forming the fissure hole 23*b* in the joint rubber 23 as explained in the foregoing, while FIG. 10 is a cross-sectional view showing a retracted state of a punch member in the fissure hole forming apparatus shown in FIG. 9, and FIG. 11 is a cross-sectional view showing an entered state of the punch member in the apparatus shown in FIG. 9.

As shown in FIGS. 9 to 11, a base member 31 of the fissure hole forming apparatus is provided with a receiving hole 31*a*, in which the joint rubber 23, prior to the formation of the fissure hole 23*b*, is set therein with an end face 23*a* positioned downwards. On the upper face of the base member 31 there are fixed a pair of guide shafts 37 extending upwards. The paired guide shafts 37 are positioned in a mutually parallel state with a distance therebetween, and are provided at the upper ends thereof with an upper plate 38. Consequently the upper ends of the guide shafts 37 are fixed by the upper plate 38, and the guide shafts 37 are fixed and supported by the upper plate 38 and the base member 31. Between the base member 31 and the upper plate 38, a movable plate 34 is mounted on the paired guide shafts 37 to be vertically slidable therealong. Also, between the movable plate 34 and the base member 31, a stripper plate 35 is mounted on the paired guide shafts 37 to be vertically slidable therealong.

On the movable plate 34, there is fixed an end of a movement limiting shaft 36 for limiting the position of the stripper plate 35 relative to the movable plate 34. The movement limiting shaft 36 extends downwards from the lower face of the movable plate 34 toward the stripper plate 35, which is mounted on the movement limiting shaft 36 in such a manner that the stripper plate 35 is vertically slidable with respect to the movable limiting shaft 36. The movement limiting shaft 36 is provided, at the lower end 36*a* thereof, with an external diameter larger than in other portions, and therefore has a shape of so-called shouldered shaft. The rim of the lower end portion 36*a* of the movement limiting shaft 36 engages with the lower face of the stripper plate 35 to limit the relative position of the stripper plate 35 in the vertical direction with respect to the movable plate 34. Also between the movable plate 34 and the stripper plate 35, a compression coil spring 41 is mounted on each guide shaft 37 so as to bias these plates. Each compression coil spring 41 is inserted between the movable plate 34 and the stripper plate 35 so as to be in a compressed state even when the stripper plate 35 is most distant from the movable plate 34. Therefore, the movable plate 34 and the stripper plate 35 are constantly biased by the compression coil springs 41 in a mutually separating direction. Thus, the movable plate 34 and the stripper plate 35 are separated by the compression coil springs 41 positioned therebetween, and maintain a predetermined relative position because the lower end portion 36*a* of the movement limiting shaft 36 limits the movement of the stripper plate 35 relative to the movable plate 34.

On the movable plate 34, there is fixed a punch member 32 for piercing a wall portion including the end face 23*a* of the joint rubber 23, thereby opening a fissure hole 23*b* in such wall portion. The punch member 32 is composed of a front end portion 32*a* of triangular pyramidal shape, an intermediate portion 32*b* of triangular pillar shape and a rear portion 32*c* of cylindrical shape. On the other hand, on the stripper plate 35, there is fixed a stripper member 33 for holding the joint rubber 23 pressed to the bottom face 31*b* of the receiving hole 31*a* of the base member 31 in forming the fissure hole 23*b* in the joint rubber 23. In the stripper member 33, there is formed a penetrating hole in which the rear portion 32*c* of the punch member 32 can be slidably fitted.

Also on the movable plate 34, there is fixed a pressing plate 39 positioned above the upper plate 38, by a pair of pressing shafts 40 penetrating through the upper plate 38. Therefore, the movable plate 34 is lowered by pressing the pressing plate 39 downwards from above, and is lifted by elevating the pressing plate 39. In order to hold the movable plate 34 at a predetermined height, locking means (not shown), such as a latch, is provided on the pressing shafts 40 and on the upper plate 38.

When the movable plate 34 is in an elevated position so as that the stripper member 33 and the punch member 32 are separated from the joint rubber 23, the stripper plate 35 and the movable plate 34 are separated by the compression coil springs 41. On the other hand, when the movable plate 34 is so lowered that the bottom face 33*a* of the stripper member 33 impinges on the inner bottom face 23*e* of the joint rubber 23, the descent of the stripper plate 35 is thereafter stopped by such impingement, whereby the movable plate 34 comes closer to the the stripper plate 35. The stripper plate 35 is provided on the upper face thereof with a protruding boss 35*a*, and, when the movable plate 34 approaches the stripper plate 35 and the bottom face of the movable plate 34 impinges on the boss 35*a*, the descent of the movable plate 34 is terminated.

In the following, the function of the fissure hole forming apparatus of the above-described configuration will be explained.

When the pressing plate 39 is pressed from above, the unrepresented locking means is released, and the movable plate 34 and the stripper plate 35 descend along with the movement of the pressing plate 39. Then, when the bottom face 33*a* of the stripper member 33 impinges on the inner bottom face 23*e* of the joint rubber 23, the descent of the stripper plate 35 is thereafter terminated and the joint rubber 23 is pinched between the stripper member 33 and the bottom face 31*b* of the receiving hole 31*a* under a predetermined load by the elastic recovery force of the compression coil springs 41.

By holding the joint rubber 23 by the stripper member 33 and the base member 31, the surface elongation of the joint rubber 23 is limited and the front end of the punch member 32 can be smoothly pierced into the inner bottom face 23*e* of the joint rubber 23. This is because, if the surface of the joint rubber 23 is significantly elongated, the piercing of the joint rubber 23 by the punch member 32 becomes difficult and there cannot be obtained a stable depth of the fissures.

Then, when the movable plate 35 is further lowered, the front end (apex of triangular pyramid) of the punch member 32 is inserted into the joint rubber 23, and the fissure hole 23*b* of the desired Y-shape is formed in the joint rubber 23 by the penetration of the end face 23*a* of the joint rubber 23 by the front end portion 32*a* (triangular pyramid), intermediate portion 32*b* (triangular pillar) and rear portion 32*c* (cylindrical shape) of the punch member 32 in succession in this order.

More specifically, in a first stage, the front end portion 32*a* of the punch member 32 is inserted into the joint rubber 23, whereby the joint rubber 23 is fissured into a Y-shape by three ridges of the triangular pyramid. In a succeeding second stage, by the penetration of the intermediate portion 32*b* of the punch member 32, the joint rubber 23 is cleaved to a predetermined fissure depth under the depression and retraction of the fissured sections of the joint rubber 23. In a final third stage, by the penetration of the rear portion 32*c* of the desired external diameter of the punch member 32, there is simulated the passing of the needle 51 in advance. The rear portion 32*c* of the punch member 32 has an external diameter the same as or larger than the external diameter of the needle 51. Through such a method, there is formed, in the joint rubber 23, a fissure hole in which the diameter of an imaginary circle passing through all the base points of the fissured sections formed by such fissures substantially coincides with the external diameter of of the needle 51, whereby the inserting and extracting operations of the needle 51 into or from the joint rubber 23 can be achieved in a stable manner.

Then the pressing plate 39 is lifted, whereby the punch member 32, penetrating through the joint rubber 23, is retracted therefrom. In this operation, since the joint rubber 23 is still held between the stripper member 33 and the base member 31, the joint rubber 23 does not move together with the ascending movement of the punch member 32.

Then, when the movable plate 34 is separated by a predetermined distance from the stripper plate 35 and the lower end portion 36*a* of the movement limiting shaft 36 impinges on the bottom face of the stripper plate 35, the stripper member 33 is elevated together with the ascent of the stripper plate 35, and is retracted from the joint rubber 23.

The formation of the fissure hole 23*b* in the fissure hole forming apparatus is executed as explained in the foregoing, but, in the ascending retraction of the punch member 32 after the formation of the fissure hole 23*b*, the peripheral portions of the fissue hole 23*b* in the joint rubber 23, namely the fissure, may be involved in the movement of the punch member 32, whereby the fissure hole 23*b* may be deformed. In the present embodiment, in penetrating the joint rubber 23 with the punch member 32, the penetration is executed from a face of the joint rubber 23 opposite to the face thereof coming into initial contact with the needle 51 at the insertion thereof into the fissure hole 23*b* of the joint rubber 23. Thus, since the punch member 32 is inserted into the joint rubber 23 from a face (inner bottom face 23*e*) opposite to the end face 23*a* of the joint rubber 23, the fissured portion forms a depression on the end face 23*a* of the joint rubber 23, even in the case of the above-mentioned deformation of the fissure hole 23*b*, so that such deformation of the fissure hole does not hinder the insertion of the needle 51.

If the punch member 32 is inserted from the side of the end face 23*a* of the joint rubber 23, the fissured portion may produce a protrusion on such end face 23*a* after the formation of the fissure hole 23*b*, and, in such case, the protruding fissured portion would hinder the insertion of the needle 51. In consideration of such fact, the punch member 32 is preferably inserted from the face (inner bottom face 23*e*) opposite to the end face 23*a*.

In the foregoing, there has been explained the stopper member having a Y-shaped fissure hole, but the stopper member having fissure hole of a different shape can be produced by suitably varying the front end portion 32*a* and the intermediate portion 32*b* of the punch member 32 according to the shape of the desired fissure hole. For example, the punch member 32 may be replaced by a punch member 180 shown in FIG. 18 or a punch member 190 shown in FIG. 19 to respectively produce a stopper member having a T-shaped fissure hole (FIG. 16) or a stopper member having a cross-shaped fissure hole (FIG. 17). The punch member 180 is provided with a front end portion 180*a* of triangular pyramidal shape having a cross-section of a rectangular triangle in a plane perpendicular to the inserting direction of the punch member, an intermediate portion 180*b* of triangular pillar shape having a cross-section of a rectangular triangle in a plane perpendicular to the inserting direction, and a rear portion 180*c* of cylindrical shape. The punch member 190 is provided with a front end portion 190*a* of rectangular pyramidal shape, an intermediate portion 190*b* of rectangular pillar shape, and a rear portion 190*c* of cylindrical shape.

The recording head, in which the stopper member having the fissure hole of the present invention is inserted in the cylindrical hole portion 16*a*, enables smooth insertion of the needle member into the stopper member without causing insertion failure in such insertion.

In the following, the connection between the head chip 15 and the frame member 16 will be explained.

In each of FIGS. 12 to 14, the head chip 15 is fixed to the frame member 16, for example, by fusion with positioning bosses 16*c*, 16*d* provided in the frame member 16 as shown in FIG. 14 or by screws 26, whereby both the head chip 15 and the frame member 16 can be easily disassembled. In the connecting portion of the frame member 16 and the chip tank 11, a filler 25 composed, for example, of silicone rubber is inserted. After the wiring board 2 and the frame member 16 are mutually aligned so that the contact pads 24*a* are provided in predetermined positions of the frame member 16, the wiring board 2 is adjoined to the frame member 16 along the lateral faces thereof.

In the following, a more detailed explanation will be given of the aforementioned configurations.

In a state where the liquid discharge recording head 100 is mounted on the carriage of the liquid discharge recording apparatus, the discharge port face, having the discharge ports 6*a*, of the liquid discharge recording head 100 is constantly maintained at a position higher than the level of the print liquid in the main tank, and the interior of the second common liquid chamber 21 is maintained at a negative pressure by connecting the liquid discharge recording head 100 and the main tank through the liquid supply path.

The second common liquid chamber 21 serves as a buffer for preserving the print liquid, and, when the print liquid is consumed by discharge from the discharge ports 6*a*, the print liquid in the second common liquid chamber 21 is suitably supplied therefrom to the first common liquid chamber 8, composed of the top plate 5 and the heater board 1. Also, as explained in the foregoing, the second common liquid chamber 21 is provided, in the wall thereof, with a connecting portion for receiving the print liquid from the main tank provided separately from the liquid discharge recording head 100 and a connecting portion for discharging air from the second common liquid chamber 21 to the exterior.

The gap between the frame member 16, constituting the second common liquid chamber 21 and the chip tank 11, is filled with the filler 25 over the entire periphery, whereby liquid tightness is secured in the second common liquid chamber 21 and the chip tank 11. However, since the filler 25 is composed, for example, of silicone rubber which is permeable by gas, the external air can enter the second common liquid chamber 21 through the filler 25. The gas entering the second common liquid chamber 21 floats therein by the floating force and remains in the gas layer in the upper part of the liquid chamber. Such gas is eventually discharged to the exterior of the second common liquid chamber 21 through the connecting portion f or dissipating the gas therefrom the exterior.

In the present embodiment, the connecting portion between the chip tank 11 and the second common liquid chamber 21 is positioned upstream of the porous member 12 with respect to the flowing direction (supply direction) of the print liquid. Stated differently, the porous member 12 is positioned at the upstream end in the chip tank 11. Therefore, the gas permeating the filler 25 does not enter the downstream side of the porous member 12 in the chip tank 11. Also, in case a solid substance is generated by coagulation of a part of the print liquid, for example, by drying in the second common liquid chamber 21, such solid substance can be collected (trapped) by the porous member 12.

The above-described configuration reduces the gas entering the downstream side of the porous member 12, namely in the flow path from the print liquid supply path 11*a* to the nozzle of the head chip 15, thereby reducing influence of the gas present in the flow path downstream of the porous member 12 on the liquid discharging performance of the liquid discharge recording head 100.

Also, since the amount of gas present in the flow path downstream of the porous member 12 is reduced, the recovery operation required at the start of operation of the liquid discharge recording head 100 after a long pause can be simplified. Consequently, the amount of the print liquid sucked from the nozzles in the recovery operation of the liquid discharge recording head 100 can be reduced and discarded, and the efficiency of use of the print liquid can be improved.

The porous member 12 is positioned in an inclined manner with respect to the flow of the print liquid in the print liquid supply path 11*a* of the chip tank 11. Therefore, the area of the porous member 12 is larger than the cross-section in a direction perpendicular to the direction of the flow path, in the vicinity of the connecting portion between the chip tank 11 and the second common liquid chamber 21. The porous member 12 positioned in such manner allows to trap, in the upper side (upstream side of the flow path) of the porous member 12 positioned in an inclined manner, the bubbles generated at the discharge of liquid droplets and floating in the print liquid supply path 11*a* opposite to the supply direction.

On the other hand, since the lower side (downstream side in the flow path) of the porous member 12 positioned in an inclined manner is always in contact with the print liquid, the flow of the print liquid from the second common liquid chamber 21 to the print liquid supply path 11*a* of the chip tank 11 through the porous member 12 is never interrupted. Consequently, the head chip 15 is always supplied with the print liquid of a constant flow amount required for liquid discharge. As explained in the foregoing, the porous member 12 in the present embodiment is positioned in an inclined manner with respect to the flow direction of the print liquid, but it is also possible to position the porous member 12 perpendicularly to the flow direction of the print liquid.

As explained in the foregoing, the liquid discharge recording head of the present invention has a stopper member consisting of an elastic member to be penetrated by a hollow needle member for liquid supply into the liquid chamber in the recording head. By forming in advance a fissure hole having fissures in not less than three directions from the crossing center of the fissures in the stopper member, the fissure hole of the stopper member in a closed state is separated under depression into not less than three fissured sections when the stopper member is pressed by impingement of the needle member, thereby obtaining an effect that the front end of the needle member can be smoothly guided to the central portion of the fissure hole. On the other hand, when the needle member is extracted from the fissure hole, the fissured sections of the stopper member promptly return to their predetermined positions by elastic recovery.

Also, even in a case that the entering trajectory of the front end of the needle member does not coincide with the position of the fissures in the stopper member, or in a case that the center of the needle member is displaced from the crossing center of the fissures, the fissured section contacted by the front end of the needle member is promptly retracted by bending deformation. Thereafter, the front end of the needle member is gradually guided to the crossing center of the fissures by the repulsive force of the deformed and retracted fissure section. The other fissure sections also cause bending deformation under further insertion of the needle member, whereby the needle member can be smoothly inserted into the stopper member. In this manner, the formation in advance of the fissure hole having fissures in not less than three directions in the stopper member decreases the frictional resistance between the needle member and the stopper member, thereby obtaining an effect of reducing the inserting load and extracting load of the needle member and improving the operability of the liquid discharge recording head at the replacing operation. Also, it is not necessary to precisely set the relative position of the needle member and the stopper member, so the liquid discharge recording apparatus can be made less expensive. The number of directions of the fissures extending from the crossing center of the fissures is preferably 3 to 5, more preferably 3 or 4, and most preferably 3.

Also, since the size of the stopper member is larger than the cross-sectional size of the hole in the frame member in a direction perpendicular to the direction of depth thereof and the stopper member is pressed into such hole, the internal walls of the fissure hole are mutually contacted by the compression force exerted by the stopper member from the periphery thereof, whereby the stopper member maintains the closed state in the non-inserted state of the needle member. Therefore, when the needle member is extracted at the replacement of the liquid discharge recording head, an effect that no leakage of air or liquid occurs from the fissure hole can be obtained. Also, in the inserted state of the needle member, a gripping force is applied to the needle member by the compressive force exerted by the stopper member from the periphery thereof, thereby obtaining an effect of preventing leakage of liquid or air in the penetrated portion of the stopper member.

Also, since the fissure hole of the stopper member is formed in advance before the stopper member is pressed into the hole portion of the frame member, the needle member is inserted or extracted along the fissure hole of the stopper member, thereby obtaining an effect that the inserting load and extracting load of the needle member is reduced in comparison with the configuration in which the stopper member is fissured by inserting a needle member with a sharp front end, and the operability is improved in the replacement of the liquid discharge recording head.

Also, in the method of the present invention for producing the stopper member of the liquid discharge recording head, by piercing the stopper member with a punch member having a front end portion of polygonal pyramidal shape, the aforementioned fissure hole is formed having fissures extended in plural directions from the crossing center of the fissures in a direction perpendicular to the direction of depth, thereby obtaining an effect of securely and simply forming the fissure hole in the stopper member.

Also, in the aforementioned producing method, by employing a punch member provided with the aforementioned front end portion, an intermediate portion of polygonal pillar shape and a rear end portion of cylindrical shape connected in this order, a highly reliable fissure hole is formed in the stopper member through a fissure hole forming process by piercing the stopper member with the front end portion, intermediate portion and rear portion of the punch member in succession and in this order, thereby obtaining an effect of enabling stable insertion and extraction of the needle member into and from the stopper member.

Also, in piercing the stopper member with the punch member, by holding the stopper member with a holding member in the periphery of the pierced portion of the stopper member, the amount of surface elongation of the stopper member is restricted at the entry of the front end portion of the punch member into the stopper member, thereby obtaining an effect of reducing the fluctuation in the fissure depth, resulting from the large surface elongation of the stopper member. Also, in retracting the punch member from the stopper member after the formation of the fissure hole, by holding the stopper member under pressure, the stopper member is not pulled out by the retracting punch member and the efficiency of production of the stopper member can be improved.

Furthermore, in piercing the stopper member with the punch member, the insertion of the punch member is executed from a face of the stopper member opposite to the face thereof coming into initial contact with the needle member at the penetration thereof into the fissure hole of the stopper member, so that, even if the fissured portion of the stopper member causes deformation by the movement of the punch member at the retraction thereof from the stopper member after the formation of the fissure hole, such deformation causes a depression in the face of the stopper member coming into initial contact with the needle member, thereby obtaining an effect that the insertion of the needle member into the stopper member is not hindered.

What is claimed is:

1. A liquid discharge recording head comprising:

plural discharge ports for discharging liquid droplets;

plural flow paths respectively communicating with said discharge ports;

plural energy generating elements provided respectively corresponding to said flow paths and adapted to generate energy for discharging the liquid in said flow paths from said discharge ports;

a first common liquid chamber positioned upstream of said plural flow paths for supplying said plural flow paths with the liquid;

a liquid supply path for supplying said first common liquid chamber with the liquid;

a second common liquid chamber provided at the upstream side of said liquid supply path and containing the liquid to be supplied to said liquid supply path; and a frame member constituting said second common liquid chamber, wherein a hole portion for liquid injection into said second common liquid chamber is provided in a part of said frame member, a stopper member comprising an elastic member is provided in said hole portion so as to close said hole portion, and said stopper member is provided, in a plane substantially perpendicular to the direction of depth of said hole portion, and completely contained within a periphery of said stopper member within the plane, with a previously-formed fissure hole aligned in the direction of depth and having fissures in not less than three directions from the crossing center of said fissures, and wherein, in a state in which a hollow needle-shaped member for liquid supply into said second common liquid chamber is inserted into said fissure hole and surrounded by the periphery of said stopper member, the liquid is supplied into said second common liquid chamber through said needle-shaped member.

2. A liquid discharge recording head according to claim 1, wherein said fissure hole formed in said stopper member has, in the plane substantially perpendicular to the direction of depth of said hole portion, fissures in not less than three directions but not exceeding five directions from the crossing center of said fissures.

3. A liquid discharge recording head according to claim 2, wherein said fissure hole formed in said stopper member has, in the plane substantially perpendicular to the direction of depth of said hole portion, fissures in three or four directions from the crossing center of said fissures.

4. A liquid discharge recording head according to claim 3, wherein said fissure hole formed in said stopper member has, in the plane substantially perpendicular to the direction of depth of said hole portion, fissures in three directions from the crossing center of said fissures.

5. A liquid discharge recording head according to claim 4, wherein said fissure hole is substantially Y-shaped in the plane substantially perpendicular to the direction of depth of said hole portion.

6. A liquid discharge recording head according to claim 1, wherein the crossing center of said fissures substantially coincides with the center of the face perpendicular to the direction of depth of said hole portion of said stopper member.

7. A liquid discharge recording head according to claim 1, wherein the distance from the front end of a fissure piece formed by two adjacent fissures to the base portion of each fissure does not exceed ½ of the external diameter of said needle-shaped member.

8. A liquid discharge recording head according to claim 1, wherein the distance from the front end of a fissure piece formed by two adjacent fissures to the base portion of each fissure is approximately ½ of the external diameter of said needle-shaped member.

9. A liquid discharge recording head according to claim 1, wherein the size of said stopper member is larger than the cross-sectional size of said hole portion of said frame member in a direction perpendicular to the direction of depth thereof, and said stopper member is pressed into said hole portion.

10. A liquid discharge recording head according to claim 1, wherein said fissure hole of said stopper member is formed therein before said stopper member is pressed into said hole portion of said frame member.

11. A liquid discharge recording head according to claim 1, wherein a porous member is provided between said liquid supply path and said second common liquid chamber.

12. A liquid discharge recording apparatus comprising a carriage mounting the liquid discharge recording head according to claim 1 and executing a reciprocating motion, a main tank containing liquid to be supplied to said second common liquid chamber of said liquid discharge recording head, and said hollow needle-shaped member to be inserted in said fissure hole of said stopper member of said liquid discharge recording head on said carriage for supplying said second common liquid chamber with the liquid from said main tank.

13. A liquid discharge recording head according to claim 1, wherein said stopper member comprises a portion extending from a periphery closing said fissure hole to said second common liquid chamber, and a space surrounded by said portion is formed.

14. A liquid discharge recording head comprising:

plural discharge ports for discharging liquid droplets;

plural flow paths respectively communicating with said discharge ports;

plural energy generating elements provided respectively corresponding to said flow paths and adapted to generate energy for discharging the liquid in said flow paths from said discharge ports;

a first common liquid chamber positioned upstream of said plural flow paths for supplying said plural flow paths with the liquid;

a liquid supply path for supplying said first common liquid chamber with the liquid;

a second common liquid chamber provided at the upstream side of said liquid supply path and containing the liquid to be supplied to said liquid supply path; and a frame member constituting said second common liquid chamber, wherein a plurality of hole portions for liquid injection into said second common liquid chamber is provided in a part of said frame member, a plurality of stopper members each comprising an elastic member is provided in said plurality of hole portions so as to close said plurality of hole portions, and each of said plurality of stopper members is provided, in a plane substantially perpendicular to the direction of depth of said plurality of hole portions, and completely contained within a periphery of a corresponding stopper member of said plurality of stopper members within the plane, with a previously-formed fissure hole aligned in the direction of depth and having fissures in not less than three directions from the crossing center of said fissures, and wherein, in a state in which a plurality of hollow needle-shaped members for liquid supply into said second common liquid chamber is inserted into said fissure holes and surrounded by the peripheries of said plurality of stopper members, the liquid is supplied into said second common liquid chamber through said needle-shaped members.

15. A liquid discharge recording head according to claim 14, wherein each of said stopper members comprises a portion extending from a periphery closing said corresponding fissure hole to said second common liquid chamber, and a space surrounded by said portion is formed.

* * * * *